US007134748B2

(12) United States Patent
Nakamura et al.

(10) Patent No.: US 7,134,748 B2
(45) Date of Patent: Nov. 14, 2006

(54) RECORDING APPARATUS

(75) Inventors: Hirokazu Nakamura, Nara (JP); Hisashi Yoshimura, Nara (JP); Takashi Goto, Nara (JP); Naozumi Ueno, Ikoma (JP); Masaki Matsushita, Ikoma-gun (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 238 days.

(21) Appl. No.: 10/732,329

(22) Filed: Dec. 9, 2003

(65) Prior Publication Data

US 2004/0119798 A1 Jun. 24, 2004

(30) Foreign Application Priority Data

Dec. 10, 2002 (JP) ..... 2002-358628

(51) Int. Cl.
*B41J 2/175* (2006.01)

(52) U.S. Cl. ..... 347/87; 347/86

(58) Field of Classification Search ..... 347/7, 347/84, 85, 86, 87
See application file for complete search history.

(56) References Cited

U.S. PATENT DOCUMENTS 6,095,643 A * 8/2000 Cook et al. ..... 347/87
6,247,807 B1 * 6/2001 Yang et al. ..... 347/87
6,467,890 B1 * 10/2002 Tajima et al. ..... 347/87
6,685,310 B1 * 2/2004 Kaga et al. ..... 347/87
6,739,711 B1 * 5/2004 Lee et al. ..... 347/87
6,848,776 B1 * 2/2005 Nishioka et al. ..... 347/86
6,880,921 B1 * 4/2005 Aponte et al. ..... 347/86
6,945,643 B1 * 9/2005 Tajima et al. ..... 347/87

FOREIGN PATENT DOCUMENTS

JP 2000-296625 10/2000

* cited by examiner

*Primary Examiner*—Anh T. N. Vo
(74) *Attorney, Agent, or Firm*—George W. Neuner; David G. Conlin; Edwards Angell Palmer & Dodge LLP

(57) ABSTRACT

The present invention can reduce the amount of ink in an outlet-side space which is sucked together with gas, without making the thickness of an isolating member for separating the inside of the sub-tank into an inlet-side space and the outlet-side space in the horizontal direction extremely thin nor making an inflow channel for allowing the ink in the inlet-side space to flow into the outlet-side space extremely small. The present invention has an isolating member in the form of a plate for separating the inside of a sub-tank coupled to a recording head into an inlet-side space connected to a main-tank and an outlet-side space connected to the recording head, and an inflow channel in the form of a slit for increasing the ink level in the inlet-side space while allowing the ink in the inlet-side space to flow into the outlet-side space from the isolating member.

21 Claims, 27 Drawing Sheets

—◇— Mo: INK LEVEL IN INLET-SIDE SPACE (FILLING)
—×— Sm: INK LEVEL IN OUTLET-SIDE SPACE (CONTINUOUS DISCHARGE)
—○— Ms: INK LEVEL IN INLET-SIDE SPACE (CONTINUOUS DISCHARGE)
—□— O: INFLOW AMOUNT (FILLING)
—△— sum: ACCUMULATED INFLOW AMOUNT (FILLING)

—◇— Mo′: INK LEVEL IN INLET-SIDE SPACE (FILLING)
—×— Sm: INK LEVEL IN OUTLET-SIDE SPACE (CONTINUOUS DISCHARGE)
—○— Ms: INK LEVEL IN INLET-SIDE SPACE (CONTINUOUS DISCHARGE)
—□— O: INFLOW AMOUNT (FILLING)
—△— sum′: ACCUMULATED INFLOW AMOUNT (FILLING)

| | SLIT | ROUND HOLE |
|---|---|---|
| INK LEVEL IN INLET-SIDE SPACE (FILLING) | Mo | Mo′ |
| ACCUMULATED INFLOW AMOUNT (FILLING) | sum | sum′ |

| | SLIT | ROUND HOLE |
|---|---|---|
| INK LEVEL IN INLET-SIDE SPACE (FILLING) | Mo | Mo′ |
| ACCUMULATED INFLOW AMOUNT (FILLING) | sum | sum′ |

FIG. 27

TABLE 1

| | BASE AREA S ($cm^2$) | FLOW RATE U (cc/min) | SLIT g (mm) | INFLECTION POINT Tc (s) | INFLECTION POINT Moc (mm) | SATURATION VALUE Mos (mm) | NORMALIZED LEVEL Moc/Mos | WASTE RATIO sum/Mo |
|---|---|---|---|---|---|---|---|---|
| FIG. 7 | 0.64 | 2 | 0.3×2 PORTIONS | 6 | 2.45 | 3.10 | 0.79 | 0.26 |
| FIG. 8 | 3.22 | 10 | 0.3×1 PORTION | 18 | 7.45 | 9.78 | 0.76 | 0.25 |
| FIG. 9 | 3.22 | 10 | 0.4×1 PORTION | 12 | 5 | 6.36 | 0.79 | 0.25 |

RECORDING APPARATUS

BACKGROUND OF THE INVENTION

The present invention relates to a recording apparatus designed to supply ink supplied to a sub-tank from a main-tank to a recording head from the sub-tank, and particularly relates to a recording apparatus suitable for use in an ink jet printer for printing data created by a personal computer, etc.

DESCRIPTION OF THE RELATED ART

Conventionally, there is known a recording apparatus comprising a main-tank fixed to a recording apparatus main body, a carriage for performing a scanning operation, and a sub-tank mounted on the carriage. FIG. 23 is a front view showing one example of the conventional recording apparatus. In this conventional recording apparatus, a main-tank 100 and a sub-tank 101 are connected together with a tube 102. When the amount of ink in the sub-tank 101 is reduced by the discharge of ink from a recording head 203, the ink in the main-tank 100 is supplied to the sub-tank 101 through the tube 102.

By the way, when such a recording apparatus is left idle for a long time, the following problems arise. Specifically, gas penetrates into ink channel through the tube wall of the tube 102, a connecting part 104 of the main-tank 100 and tube 102, and a connecting part 105 of the sub-tank 101 and tube 102, and bubbles are formed in the ink channel. These bubbles accumulate in the sub-tank 101 soon.

FIG. 24 is a cross sectional view showing the state in which gas accumulates in the sub-tank of the conventional recording apparatus. Here, as shown in FIG. 24, when the amount of gas (bubbles) accumulated in the sub-tank 101 increases, stable supply of ink from the tube 102 to the sub-tank 101 cannot be performed, and therefore it is necessary to remove the gas accumulated in the sub-tank 101. However, for the removal of gas in the sub-tank 101, even when a suction channel of a vacuum pump, for example, is connected to a nozzle part of the recording head 103 to suck out the gas in the sub-tank 101 from the nozzle part, only the ink on the bottom side of the sub-tank 101 is sucked and the gas accumulated in the upper part of the sub-tank 101 can not be removed.

FIG. 25 is a cross sectional view of a conventional recording apparatus capable of removing the gas accumulated in the sub-tank, and FIG. 26 is an enlarged cross-sectional view of a meniscus section in the sub-tank. In this recording apparatus, ink supply tube 106 for supplying ink from a sub-tank 101*a* to a recording head 103*a* projects from the bottom into the sub-tank 101*a*, and a meniscus forming section 107 is formed on the side face of ink supply tube 106.

The meniscus forming section 107 has a pore opening into the ink supply tube 106. When the gas in the sub-tank 101*a* is sucked out through the nozzle part of the recording head 103*a* from the top end of the ink supply tube 106 in the state in which the ink level in the sub-tank 101*a* is below the position of the pore, the pressure in the sub-tank 101*a* becomes negative and the ink is supplied from the main-tank into the sub-tank 101*a*, while, when the ink level in the sub-tank 101*a* rises over the position of the pore, the pore is closed by ink film (meniscus) because of surface tension. At this time, as shown in FIG. 26, the contact angle of the meniscus 107*a* with the inside of the ink supply tube 106 becomes larger than 90 degrees. Then, the closed state of the pore by the meniscus 107*a* is maintained until the ink in the sub-tank 101*a* overflows the ink supply tube 106, and the meniscus 107*a* in the pore is broken by the ink overflowed into the ink supply tube 106 and the ink in the sub-tank 101*a* flows into the ink tube 106 from the pore (for example, Japanese Patent Application Laid-Open No. 2000-296625).

However, the structure of the sub-tank 101*a* of the Japanese Patent Application Laid-Open No. 2000-296625 has the following problems. First, in order for the meniscus 107*a* formed in the meniscus forming section 107 due to surface tension to withstand the head of ink created by the ink accumulated to the height of the top end of the ink supply tube 106 from the meniscus forming section 107 (pore), it is necessary to decrease the pore of the meniscus forming section 107 to a very small diameter. For example, for the head of ink of 20 mm, it is necessary to increase the factor of safety by two times and make the diameter of the pore 300 μm or less. By the way, in order to utilize the meniscus 107*a* caused by surface tension, the ink supply tube 106 in which the pore is formed needs to be made of a water repellent material that is hard to wet, and the contact angle in the ink supply tube 106 needs to be larger than 90 degrees. Accordingly, it is difficult to form a pore with an extremely small dimension.

Moreover, even if a small pore is formed, there is a drawback that the small pore is clogged with a small bubble formed in the sub-tank 101*a*. Further, the ink supply tube 106 in which the pore is formed needs to be very thin. The reason for this is that, when the ink successively accumulated in the sub-tank 101*a* from the main-tank overflows and inflows into the ink supply tube 106, the inflow ink needs to wet the meniscus forming section 107 and breaks the meniscus 107*a* caused by surface tension. Besides, when there is a deposit adhering to the meniscus forming section (pore) 107, the meniscus 107*a* cannot be formed in a stable manner.

SUMMARY OF THE INVENTION

The present invention has been made with the aim of solving the above problems, and it is an object of the present invention to provide a recording apparatus which comprises a sub-tank whose inside is separated into an inlet-side space and an outlet-side space in the horizontal direction by an isolating member, and an inflow channel for increasing the ink level in the inlet-side space while allowing the ink in the inlet-side space to flow into the outlet-side space from the isolating member, and thereby capable of reducing the amount of ink in the outlet-side space which is sucked together with gas and improving the manufacturability of the sub-tank without making the inflow channel extremely small nor making the thickness of the isolating member extremely thin.

Another object is to provide a recording apparatus capable of reducing the time taken for the ink level in the inlet-side space and the ink level in the outlet-side space to be in equilibrium after the suction and removal of gas, by forming the inflow channel in a size allowing inflow of ink when the ink level is present at the position of the inflow channel and arranging the surface connected to the terminal end of the inflow channel to be a surface made of a material wettable by the ink.

Still another object is to provide a recording apparatus with the isolating member in the form of plate, capable of easily setting the inflow amount of ink into the outlet-side space per unit time according to the size of the sub-tank, the kind of ink, etc.

Still another object is to provide a recording apparatus with a plurality of inflow channels, and thereby allow inflow of ink into the outlet-side space from the inlet-side space even when a part of inflow channel is clogged with a bubble adhering to the inflow channel.

Still another object is to provide a recording apparatus with the inflow channel in the form of a slit, capable of further reducing the amount of ink in the outlet-side space which is sucked together with gas as compared to a recording apparatus with the inflow channel in the form of a round hole.

Still another object is to provide a recording apparatus capable of easily setting the inflow amount of ink into the outlet-side space per unit time, according to the size of the sub-tank, the kind of ink, etc., by arranging the longitudinal direction of the inflow channel in the form of a slit to lie in the up-down direction.

Still another object is to provide a recording apparatus capable of improving the manufacturability of the sub-tank with the inflow channel by positioning the inflow channel between the inside surface of the sub-tank and the isolating member.

Still another object is to arrange the width dimension of the inflow channel to be shorter on the lower side of the sub-tank and longer on the upper side, and thereby provide a recording apparatus capable of reducing the amount of ink in the outlet-side space which is sucked together with gas and reducing the time taken for the ink level in the inlet-side space and the ink level in the outlet-side space to be in equilibrium after the suction and removal of gas as compared to a recording apparatus with an inflow channel having the same width dimension throughout the entire length.

Still another object is to arrange the distance from the start end to the terminal end of the inflow channel to be longer on the lower side of the sub-tank and shorter on the upper side, and thereby provide a recording apparatus capable of reducing the amount of ink in the outlet-side space which is sucked together with gas and reducing the time taken for the ink level in the inlet-side space and the ink level in the outlet-side space to be in equilibrium after the suction and removal of gas as compared to a recording apparatus with an inflow channel having the same width dimension throughout the entire length.

Still another object is to provide a recording apparatus capable of improving the manufacturability of the sub-tank with the inflow channel by using, as the isolating member, a plate with a width dimension smaller than the dimension between the opposing side faces in a sub-tank main body.

Still another object is to provide a recording apparatus capable of setting the size and configuration of the inflow channel without being influenced by the sub-tank main body, by forming a recess as the inflow channel in the peripheral surface of the isolating member that is a separate plate from the sub-tank main body.

Still another object is to provide a recording apparatus capable of setting the size and configuration of the inflow channel without being influenced by the sub-tank main body, by forming the inflow channel in the isolating member that is a separate plate from the sub-tank main body.

Still another object is to provide a recording apparatus comprising a detector for detecting the ink level in the outlet-side space, and thereby capable of obtaining the ink level more accurately than by finding the ink level from the ink discharge time or the number of times of discharge of ink.

Still another object is to provide a recording apparatus capable of preventing a bubble from being held in the inflow channel and achieving a stable connected state, by arranging a surface in the vicinity of the inflow channel to be a surface that causes the contact angle of ink to be 90 degrees or less from the terminal end of the inflow channel to the outlet-side space.

Still another object is to provide a recording apparatus capable of performing stable supply of ink to the outlet-side space, by designing the ink level in the inlet-side space and the ink level in the outlet-side space to be substantially in equilibrium within a time from the completion of filling the ink into the sub-tank to the discharge of ink in the sub-tank through the recording head.

Still another object is to provide a recording apparatus capable of efficiently filling as much as possible ink by enabling the suction for filling to be stopped at an inflection point at which the amount of ink filled is about 80% of the saturation value.

Still another object is to provide a recording apparatus capable of further efficiently filling as much as possible ink by stopping the suction for filling at the time the amount of ink filled reaches almost 80% of the saturation value.

A recording apparatus of the present invention is a recording apparatus constructed to supply ink to a recording head from a main-tank through a sub-tank, and characterized by comprising: an isolating member for separating the inside of the sub-tank into an inlet-side space connected to the main-tank and an outlet-side space connected to the recording head in the horizontal direction; and an inflow channel for increasing the ink level in the inlet-side space while allowing the ink in the inlet-side space to flow into the outlet-side space in a region of the isolating member.

According to this invention, since the inflow amount of ink supplied to the inlet-side space from the main-tank into the outlet-side space can be limited by the inflow channel and the inflow amount can be made smaller compared to the amount of ink supplied to the inlet-side space from the main-tank, it is possible to reduce the amount of ink in the outlet-side space which is sucked together with gas when sucking and removing the gas accumulated in the sub-tank from the recording head side. Additionally, since the inflow channel is designed to increase the ink level in the inlet-side space while allowing the ink in the inlet-side space to flow into the outlet-side space, there is no need to form an extremely small inflow channel and an extremely thin isolating member, thereby improving the manufacturability of the sub-tank and reducing the cost of the recording apparatus.

Moreover, a recording apparatus of the present invention is characterized in that the inflow channel has a size allowing inflow of the ink when the ink level is present at the position of the inflow channel, and the surface connected to the terminal end of the inflow channel is made of a material that is wettable by the ink. According to this invention, when the ink level in the inlet-side space reaches the position of the inflow channel, it is possible to certainly cause the ink in the inlet-side space to flow into the outlet-side space from the inflow channel, and decrease the time taken for the ink level in the inlet-side space and the ink level in the outlet-side space to be in equilibrium after the suction and removal of gas.

Besides, a recording apparatus of the present invention is characterized in that the isolating member is in the form of a plate. According to this invention, since the inflow resistance of ink can be changed by selecting a thickness of the isolating member, it is possible to easily set the inflow amount of ink into the outlet-side space per unit time according to the size of the sub-tank, the kind of ink, etc.

Further, a recording apparatus of the present invention is characterized in that a plurality of the inflow channels are formed. According to this invention, the aperture configuration of each of the inflow channels can be set in various ways, and, even when a part of inflow channel is clogged with a bubble adhering to the inflow channel, it is possible to allow the ink to flow into the outlet-side space from the inlet-side space. In addition, by arranging a plurality of inflow channels in a line, it is possible to obtain the same effect as that obtained by the inflow channel in the form of a slit.

Besides, a recording apparatus of the present invention is characterized in that the inflow channel is a slit. According to this invention, the head of equilibrium ink in the inlet-side space and that in the outlet-side space are the same, and it is possible to reduce the inflow amount of ink into the outlet-side space from the inlet-side space per unit time when filling the ink as compared to the inflow channel in the shape of a round hole. Consequently, when performing the suction and removal of gas in the sub-tank by sucking the gas from the recording head side, it is possible to further reduce the amount of ink in the outlet-side space which is sucked together with gas.

Further, a recording apparatus of the present invention is characterized in that the inflow channel is arranged so that the longitudinal direction thereof lies in the up-down direction. According to this invention, since the inflow amount of ink into the outlet-side space from the inlet-side space per unit time can be set by varying the width dimension of the inflow channel throughout the entire length or the length from the start end to the terminal end of inflow, it is possible to easily set the inflow amount of ink into the outlet-side space per unit time according to the size of the sub-tank, the kind of ink, etc.

Additionally, a recording apparatus of the present invention is characterized in that the inflow channel is positioned between the inside surface of the sub-tank and the isolating member. According to this invention, since the inflow channel can be formed when forming the isolating member integrally with or separately from the sub-tank main body, the manufacturability of the sub-tank having the inflow channel can be improved.

Besides, a recording apparatus of the present invention is characterized in that the width dimension of the inflow channel is shorter on the lower side of the sub-tank and longer on the upper side. According to this invention, since the inflow amount of ink per unit time on the lower side can be made smaller than that on the upper side, it is possible reduce the amount of ink in the outlet-side space which is sucked together with gas. Furthermore, since the inflow amount of ink per unit time on the upper side can be made larger than that on the lower side, the time taken for the ink level in the inlet-side space and the ink level in the outlet-side space to be in equilibrium after the suction and removal of gas can be shortened compared to a recording apparatus with an inflow channel having the same width dimension throughout the entire length.

Moreover, a recording apparatus of the present invention is characterized in that the distance from the start end to the terminal end of the inflow channel is made longer on the lower side of the sub-tank and shorter on the upper side. According to this invention, since the inflow amount of ink per unit time on the lower side can be made smaller than that on the upper side, it is possible reduce the amount of ink in the outlet-side space which is sucked together with gas. Furthermore, since the inflow amount of ink per unit time on the upper side can be made larger than that on the lower side, the time taken for the ink level in the inlet-side space and the ink level in the outlet-side space to be in equilibrium after the suction and removal of gas can be shortened compared to a recording apparatus in which the distance from the start end to the terminal end of the inflow channel is equal.

In addition, a recording apparatus of the present invention is characterized in that the sub-tank has a sub-tank main body coupled to the recording head, and the isolating member is a plate with a width dimension smaller than the dimension between the opposing side faces in the sub-tank main body. According to this invention, since the inflow channel can be formed when forming the isolating member integrally with or separately from the sub-tank main body, it is possible to improve the manufacturability of the sub-tank having the inflow channel.

Further, a recording apparatus of the present invention is characterized in that the sub-tank has a sub-tank main body coupled to the recording head, and the isolating member is a separate plate from the sub-tank main body and has a recess to be the inflow channel in the peripheral surface of the isolating member. According to this invention, since the inflow channel can be formed when forming the isolating member that is a separate body from the sub-tank main body, it is possible to set the size and configuration of the inflow channel without being influenced by the sub-tank main body.

Besides, a recording apparatus of the present invention is characterized in that the sub-tank has a sub-tank main body coupled to the recording head, and the isolating member is a separate plate from the sub-tank main body and has the inflow channel. According to this invention, since the inflow channel can be formed when forming the isolating member that is a separate body from the sub-tank main body, it is possible to set the size and configuration of the inflow channel without being influenced by the sub-tank main body.

Moreover, a recording apparatus of the present invention is characterized in that the sub-tank has a detector for detecting the ink level in the outlet-side space. According to this invention, since the ink level in the outlet-side space can be detected by the detector, it is possible to obtain the ink level more accurately than by finding the ink level in the outlet-side space from the ink discharge time or the number of times of ink discharge. Consequently, it is possible to reduce the amount of ink in the outlet-side space which is sucked together with gas to a minimum necessary amount.

In addition, a recording apparatus of the present invention is characterized in that the vicinity of the inflow channel has a surface that causes the contact angle of the ink to be 90 degrees or less from the terminal end of the inflow channel to the outlet-side space. According to this invention, since the member having the inflow channel is made of a material with a relatively high wettability, the vicinity of the inflow channel is stably in a wet state, thereby preventing a bubble from being held in the inflow channel, achieving a stable connected state, and reducing the change in the inflow amount of ink per unit time.

Besides, a recording apparatus of the present invention is characterized in that, if the base area of the inlet-side space is S ($m^2$), ink inflow resistance of the inflow channel is R ($N \cdot s/m^5$), and the time from completion of filling the ink into the sub-tank to discharge of the ink in the sub-tank from the recording head is To (second), then the R is set to satisfy $R \cdot s/(9.8 \times 10^3) < To$. According to this invention, the next discharge of the ink from the recording head can be performed in the state in which the ink level in the inlet-side space and the ink level in the outlet-side space have substantially reached equilibrium, and stable supply of the ink to the outlet-side space can be achieved.

Moreover, a recording apparatus of the present invention is characterized in that, if the saturation value of amount of ink filled into the inlet-side space is Mos, the elapsed time when the amount of ink filled has reached 80% of the saturation value is Tc (second), and the time at which suction for filling is stopped is Te (second), then the Te/Tc is set to satisfy Te/Tc<1.5 (second). According to this invention, the inflection point of the ink level in the inlet-side space is a value of about 80% of the saturation value and the suction for filling can be stopped at this inflection point, and therefore it is possible to efficiently fill as much as possible ink when filling the ink into the sub-tank while sucking and removing the gas from the recording head side.

Further, a recording apparatus of the present invention is characterized in that the Tc and Te are set to satisfy Te≈Tc. According to this invention, since the suction for filling is stopped at the time the amount of ink filled reaches almost 80% of the saturation value, it is possible to more efficiently fill as much as possible ink when filling the ink into the sub-tank while sucking and removing the gas from the recording head side.

The above and further objects and features of the invention will more fully be apparent from the following detailed description with accompanying drawings.

BRIEF DESCRIPTION OF THE DRAWINGS

FIGS. 2A and 2B show the structure of a sub-tank of the recording apparatus of the present invention, wherein FIG. 2A is an enlarged cross sectional view, and FIG. 2B is a cross sectional view cut along the II—II line of FIG. 2A;

FIGS. 11A and 11B show another structure of the sub-tank of the recording apparatus of the present invention, wherein FIG. 11A is an enlarged cross sectional view, and FIG. 11B is a cross sectional view cut along the XI—XI line of FIG. 11A;

FIGS. 16A and 16B show still another structure of the sub-tank of the recording apparatus of the present invention, wherein FIG. 16A is an enlarged cross sectional view, and FIG. 16B is a cross sectional view cut along the XVI—XVI line of FIG. 16A;

FIG. 27 is Table 1, which indicates collectively the waste ratio, normalized level, etc. shown in FIGS. 7 through 9.

DETAILED DESCRIPTION OF THE PREFERRED EMBODIMENTS

Figure 1:
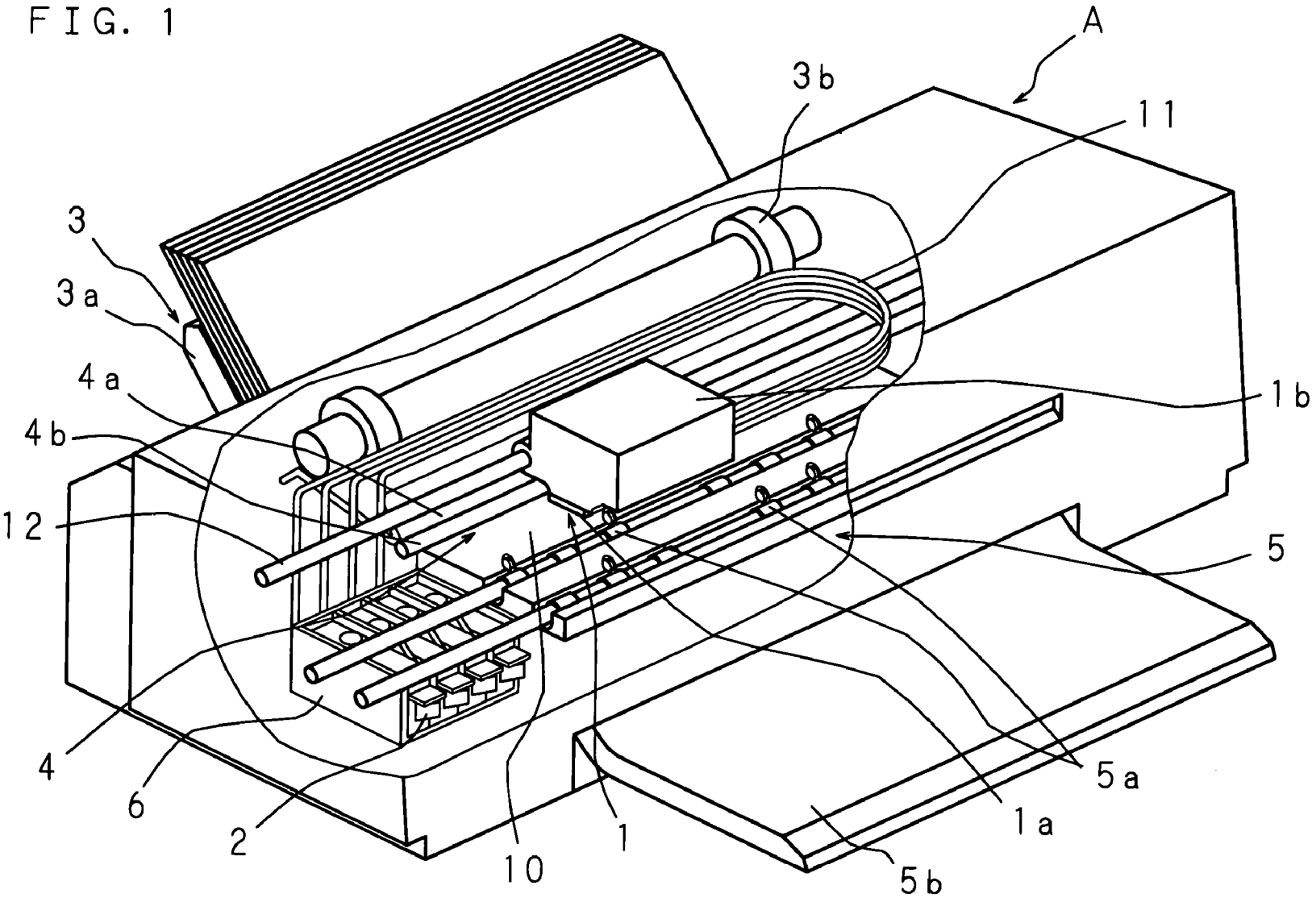
FIG. 1 is a perspective view showing the configuration of a recording apparatus of the present invention.

The following description will explain in detail the present invention, based on the drawings illustrating some embodiments thereof. FIG. 1 is a perspective view showing the configuration of a recording apparatus of the present invention. The recording apparatus of FIG. 1 is an ink jet printer, and comprises a printing unit 1 for performing printing on a sheet (recording sheet); a main-tank 2 for supplying ink to the printing unit 1; a paper feed unit 3 for feeding sheets to the printing unit 1; a separation unit for supplying the sheets supplied from the paper feed unit 3 to the printing unit 1 one sheet at a time; a transport unit 4 for transporting the sheets supplied one sheet at a time from the separation unit to the printing unit 1; a discharge unit 5 for discharging a sheet on which printing was performed in the printing unit 1 to the outside; and a tank mount unit 6 in which the main-tank 2 is mounted.

The printing unit 1 comprises a recording head 1*a* with a nozzle for discharging ink at a position facing a platen 10, a sub-tank (not shown) which is connected to the main-tank 2 through a tube 11 and supplies the ink supplied from the main-tank 2 to the recording head 1*a*, and a carriage 1*b* on which the recording head 1*a* and the sub-tank are mounted and which is movable in a main scanning direction along a guide line 12. The sub-tank is provided so as to supply the ink in the main-tank 2 to the recording head 1 in a stable manner, and is connected to the main-tank 2 through the tube 11.

The paper feed unit 3 has a feed tray 3*a* and a pickup roller 3*b*, and performs the function of storing sheets when printing is not performed. The separation unit has a pad part and a feed roller (not shown) that come into contact with a sheet, and the pad part is designed so that the friction between the pad part and a sheet is greater than the friction between stacked sheets. Besides, the feed roller is set so that the friction between the feed roller and the sheet is greater than the friction between the pad and the sheet and the friction between the sheets. Therefore, even when two stacked sheets are fed to the separation unit, these sheets can be separated by the feed roller, and only the upper sheet is sent to the transport unit 4.

The transport unit 4 has a guide plate (not shown), a transport and push roller 4*a*, and a transport roller 4*b*. When sending a sheet between the recording head la of the printing unit 1 and the platen 10, the transport and push roller 4*a* and the transport roller 4*b* adjust the transport of the sheet so that the ink discharged from the recording head 1*a* is sprayed to appropriate positions on the sheet. The discharge unit 5 has a pair of discharge rollers 5*a*, 5*a*, and a discharge tray 5*b*.

A recording apparatus A constructed as described above performs printing by the following operations. First, a printing request based on image information is sent to the recording apparatus A from a personal computer (not shown) or the like. The recording device A that has received the printing request causes the pickup roller 3*b* to transport a sheet on the feed tray 3*a* from the paper feed unit 3.

The transported sheet is passed through the separation unit by the feed roller and sent to the transport unit 4. In the transport unit 4, the transport and push roller 4*a* and the transport roller 4*b* send the sheet between the recording head 1*a* and the platen 10. Then, in the printing unit 1, the ink is sprayed to the sheet on the platen 10 through the nozzle of the recording head 1, according to the image information. At this time, the sheet is temporarily stopped on the platen 10. The carriage 1*b* is guided by the guide line 12 and moved in a main scanning direction to scan one line while the ink is being sprayed. When this scanning is complete, the sheet is moved by only a certain width in a sub scanning direction on the platen 10. In the printing unit 1, by continuously performing the above-described process according to the image information, printing is performed on the entire surface of the sheet. The printed sheet passes through an ink drying unit and is discharged onto the discharge tray 5*b* by the discharge rollers 5*a*, 5*a*. Then, the sheet is provided as a printed matter to a user.

Figure 2A:
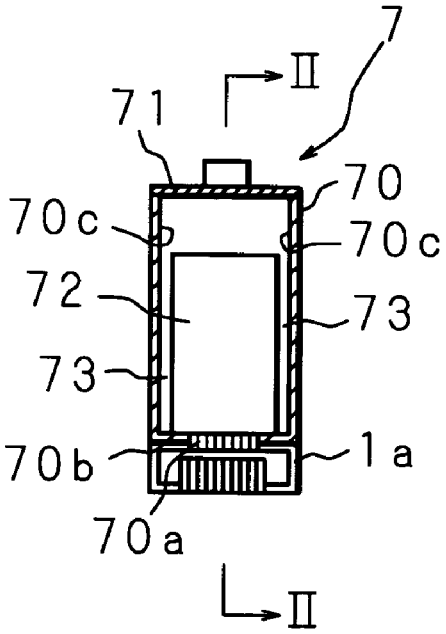
Figure 2B:
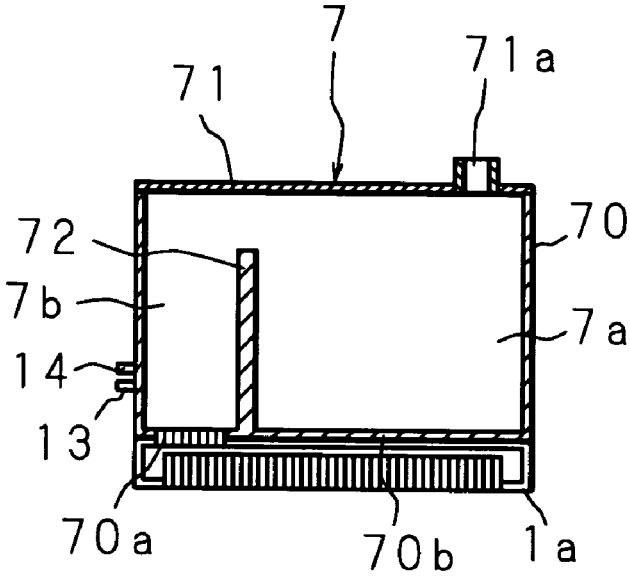

FIGS. 2A and 2B show the structure of a sub-tank, wherein FIG. 2A is an enlarged cross sectional view, and FIG. 2B is a cross sectional view cut along the II-II line of FIG. 2A. A sub-tank 7 comprises a rectangular parallelepiped sub-tank main body 70 having a mesh section 70*a* at the bottom and an open top; a lid body 71 for closing the open section of the sub-tank main body 70; an isolating member 72 for separating the inside of the sub-tank main body 70 into an inlet-side space 7*a* and an outlet-side space 7*b* in the horizontal direction (the left-right direction); and an inflow channel 73 for allowing the ink in the inlet-side space 7*a* to flow into the outlet-side space 7*b*. The sub-tank main body 70 and the isolating member 72 are formed from a synthetic resin material wettable by the ink.

In the sub-tank main body 70, the rectangular bottom and four sides connected to the peripheral edge of the bottom are formed integrally, and the lid body 71 formed separately is coupled to the top ends of these sides. The bottom of this sub-tank main body 70 is coupled to the recording head so as to supply the ink therein to the recording head 1*a* from the mesh section 70*a*. Moreover, an ink supply opening 71*a* of the lid body 71 is connected to the main-tank 2 through the tube 11. Note that the tube 11 is detachably connected to the sub-tank 7.

The isolating member 72 is a plate formed integrally with the sub-tank main body 70 and has both sides lying in the up-down direction. By forming the lower part of the isolating member 72 integrally with the bottom 70*b* of the sub-tank main body 70, the isolating member 72 separates the sub-tank 7 into the inlet-side space 7*a* connected to the main-tank 2 and the outlet-side space 7*b* connected to the recording head 1*a*. Further, the width dimension of the isolating member 72 is made smaller than the dimension between the opposing side faces 70*c*, 70*c* in the sub-tank main body 70, and the slit-like gaps between both ends in the width direction and the side surfaces 70*c*, 70*c* are made inflow channels (hereinafter referred to as the slits) 73 for increasing the ink level in the inlet-side space 7*a* while allowing the ink in the inlet-side space 7*a* to flow into the outlet-side space 7*b*. The slit 73 is formed so that the longitudinal direction thereof lies in the up-down direction and it has a width allowing inflow of ink when the ink level is present at the position of the slit 73. In addition, the isolating member 72 has a height lower than the height of the inside of the sub-tank main body 70 so as to allow the ink in the inlet-side space 7*a* to overflow into the outlet-side space 7*b*.

Figure 3:
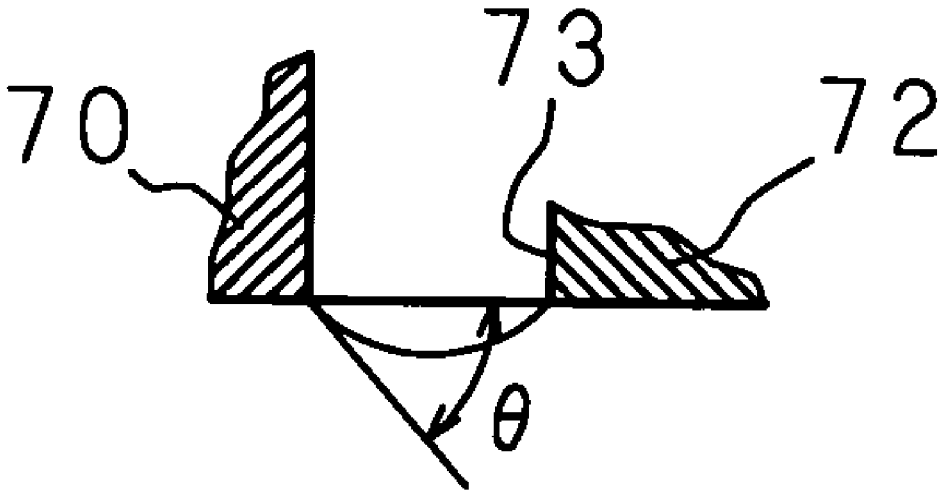
FIG. 3 is an explanatory view of a contact angle in the vicinity of an inflow channel of the recording apparatus of the present invention.

FIG. 3 is an explanatory view of a contact angle in the vicinity of the inflow channel. At least the surfaces of the sub-tank main body 70 and isolating member 72 in the vicinity of the slit 73 are arranged so that the contact angle of ink is 90 degrees or less from the terminal end of the slit 73 to the outlet-side space 7*b* (see FIG. 3). Specifically, by arranging the surface connected to the terminal end of the slit 73 to be a non-water repellent surface and a face made of a material with a relatively high wettability with respect to the ink, the vicinity of the slit 73 is stably in a wet state, and thereby preventing a bubble from being held in the slit 73, achieving a stable connected state, and reducing the change in the inflow amount of ink per unit time. As the means for imparting non-water repellent and wettable characteristics to the surfaces in the vicinity of the slit 73, the sub-tank main body 70 and the isolating member 72 are made of a synthetic resin, or it may be possible to perform a surface treatment using a material such as a non-water repellent coating, a hydrophilic treatment using plasma, or a chemical surface treatment.

On one side of the outlet-side space 7*b* of the sub-tank main body 70, there are a translucent section (not shown) and two detectors 13, 14 for detecting the ink level in the outlet-side space in the translucent section. The detectors 13 and 14 are connected to a control unit (not shown) using a microprocessor, and a control signal is outputted to a suction device (not shown) from the control unit, based on the ink level detected by each of the detectors 13 and 14. Besides, the detectors 13 and 14 are positioned so that they are separated in the up-down direction.

When a certain amount of gas is accumulated in the sub-tank 7 and the amount of ink remaining in the sub-tank 7 is decreased to a set amount, the lower detector 13 activates the suction device to suck and remove the gas in the sub-tank 7 through the nozzle of the recording head 1*a*. Further, when the ink supplied to the inlet-side space 7*a* from the main-tank 2 with the suction and removal of gas by the suction device overflows into the outlet-side space 7*b* from the top end of the isolating member 72 and the amount of ink in the outlet-side space 7*b* is increased to a set amount, the upper detector 14 stops the suction and removal operation of the suction device.

Figure 4:
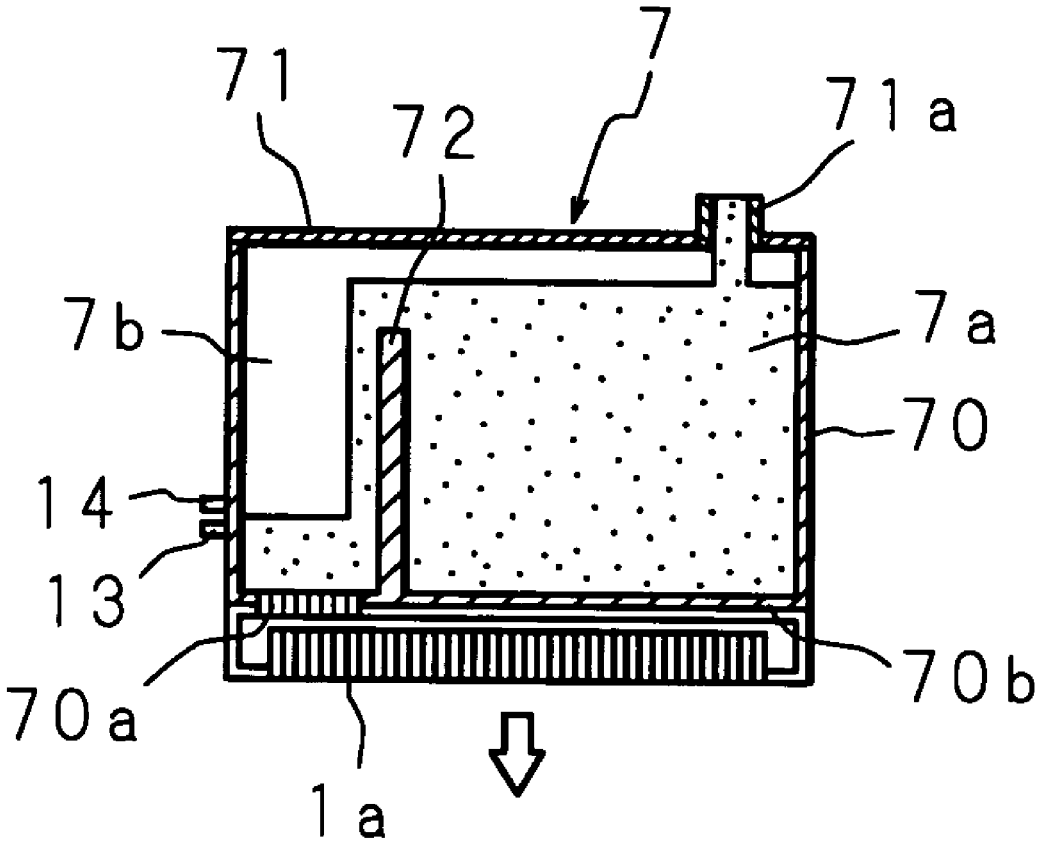
FIG. 4 is an explanatory view of the state in which the ink is supplied at a high flow rate to the sub-tank of the recording apparatus of the present invention.

Next, the following description will explain the state of ink when filling the sub-tank with the ink. FIG. 4 is an explanatory view of the state in which the ink is supplied at a high flow rate to the sub-tank 7. At the time of initial ink filling and maintenance, the ink is supplied from the main-tank 2 to the sub-tank 7 at a high flow rate (for example, 2 cc/min). Note that the term "at the time of maintenance" means a time at which minute bubbles mixed in the ink are accumulated in the sub-tank 7 gradually during use while repeatedly filling the ink into the sub-tank 7, a certain amount of gas is accumulated, and the amount of ink remaining in the sub-tank 7 is decreased.

Before the initial ink filling is performed, the ink is not filled at all, and the sub-tank 7 is filled with gas. When performing maintenance, as described above, gas and a relatively small amount of ink are accumulated in the sub-tank 7. Thus, in order to perform a stable printing operation, it is necessary to discharge the gas in the sub-tank 7 and supply the ink from the main-tank 2 into the sub-tank 7.

In this embodiment, by providing the slits 73, the gas can be easily removed from the sub-tank 7, and the ink can be supplied from the main-tank 2 to the sub-tank 7 when removing the gas. The following description will explain the state of ink in the sub-tank 7 during the removal of gas in the presence of the slits 73.

Figure 5:
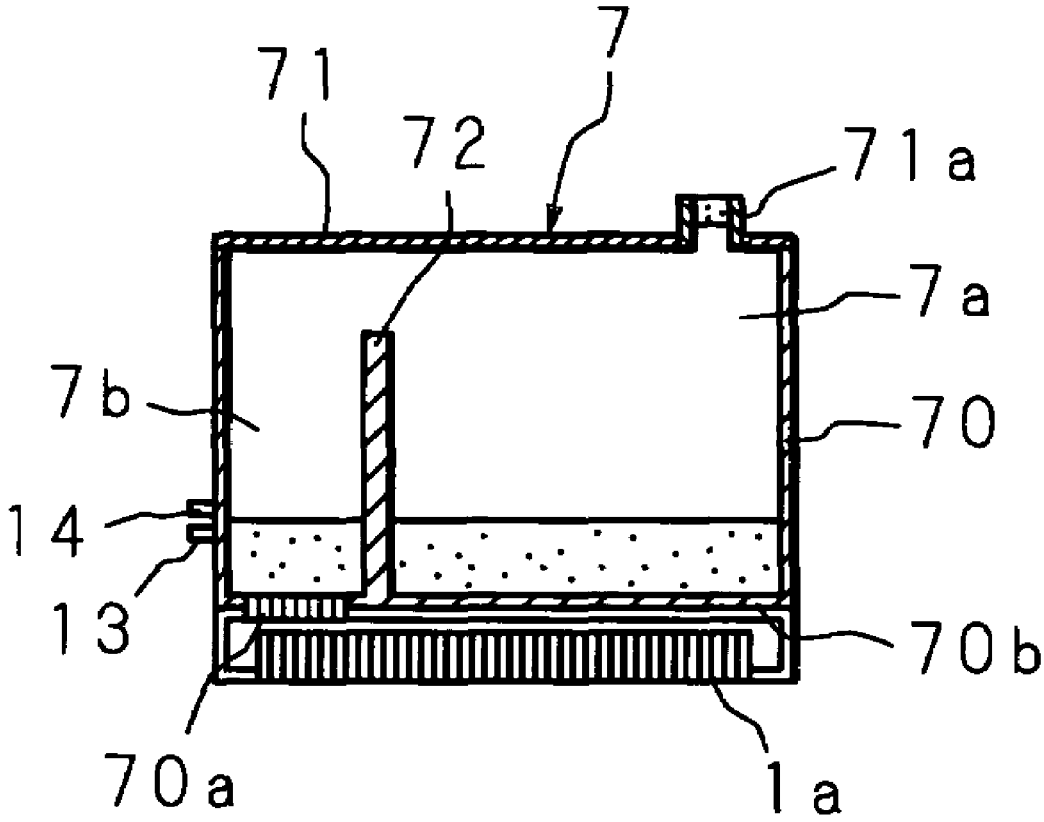
FIG. 5 is an explanatory view showing the state of the ink at the time of maintenance of the recording apparatus of the present invention.

FIG. 5 is an explanatory view showing the state of ink in the sub-tank at the time of maintenance. Here, when the suction device (not shown) is used to suck and remove the gas accumulated in the sub-tank 7 through the nozzle part of the recording head 1*a*, first, a small amount of ink accumulated in the lower part of the outlet-side space 7*b* is sucked from the mesh section 70*a*.

However, all of the ink remaining in the sub-tank 7 can not be sucked from the mesh section 70*a*. The reason for this is that, although the inlet-side space 7*a* and the outlet-side space 7*b* are isolated from each other by the isolating member 72 and connected to each other with the slits 73 as described above, a decrease in the ink level in the outlet-side space 7*b* and a decrease in the ink level in the inlet-side space 7*a* are not the same due to the ink inflow resistance caused by the slits 73.

In order to examine the relationship between the width dimension of the slit 73 and the ink levels, the sub-tank 7*b* with the base area S=0.644 ($cm^2$) of the inlet-side space 7*a*, the base area=0.34 ($cm^2$) of the outlet-side space 7*b*, and the thickness L=1 (mm) of the isolating member 72 was used, and the ink levels were measured when they came to equilibrium in performing suction at a constant flow rate U to fill the ink with surface tension $\eta$=0.03 (N/m), viscosity $\mu$=0.007 (Pa·s) and specific gravity $\gamma$=1.1.

Figure 6:
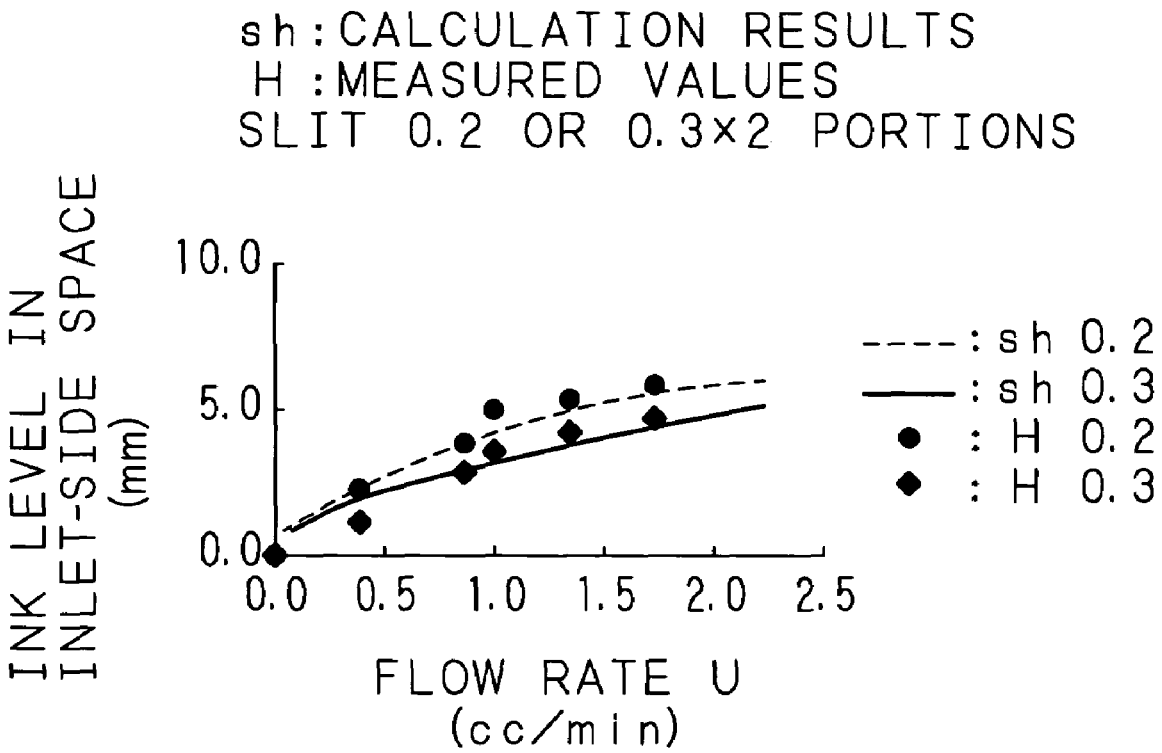
FIG. 6 is an explanatory view showing the relationship between the flow rate to the inlet-side space and ink level in an equilibrium state when the width dimension of a slit of the recording apparatus of the present invention is varied.

FIG. 6 is an explanatory view showing the relationship between the flow rate into the inlet-side space and the ink level in the equilibrium state for various width dimensions of the slit. In FIG. 6, the relationship when the slit 73 has a width g=0.2 (mm) is plotted with " ", and the relationship when the slit 73 has a width g=0.3 (mm) is plotted with "◆". Further, the broken line of FIG. 6 shows the calculation result obtained by substituting the width g=0.2 (mm) of the slit 73 into the expression of analysis result (13) that takes into account the configuration of the slit 73 as explained in detail later, while the solid line of FIG. 6 shows the calculation result for the width g=0.3 (mm). It was confirmed from FIG. 6 that the actually measured values and the calculation results were almost the same, and the later-described sequence of analysis was correct.

Figure 7:
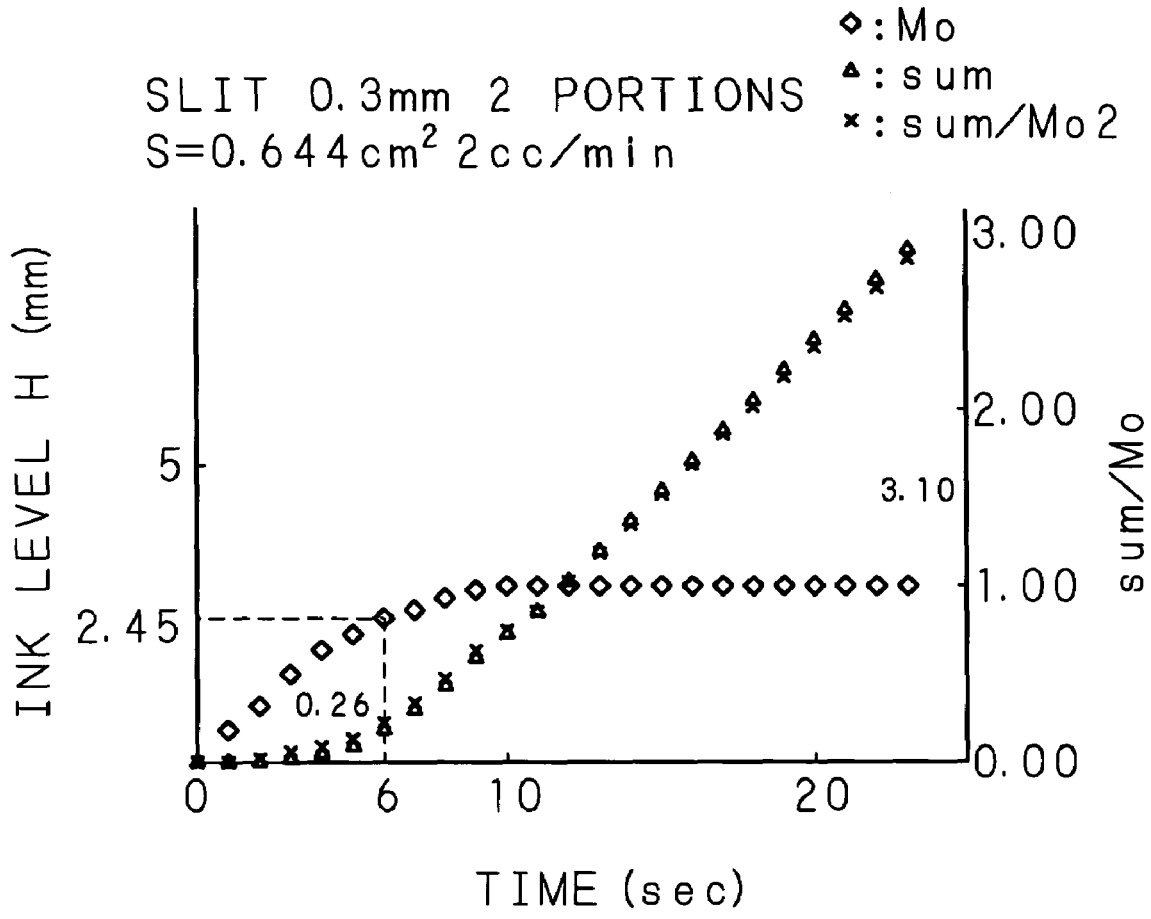
FIG. 7 is an explanatory view showing the relationship among the outflow amount, waste ratio and normalized level under the same condition of the recording apparatus of the present invention.
Figure 8:
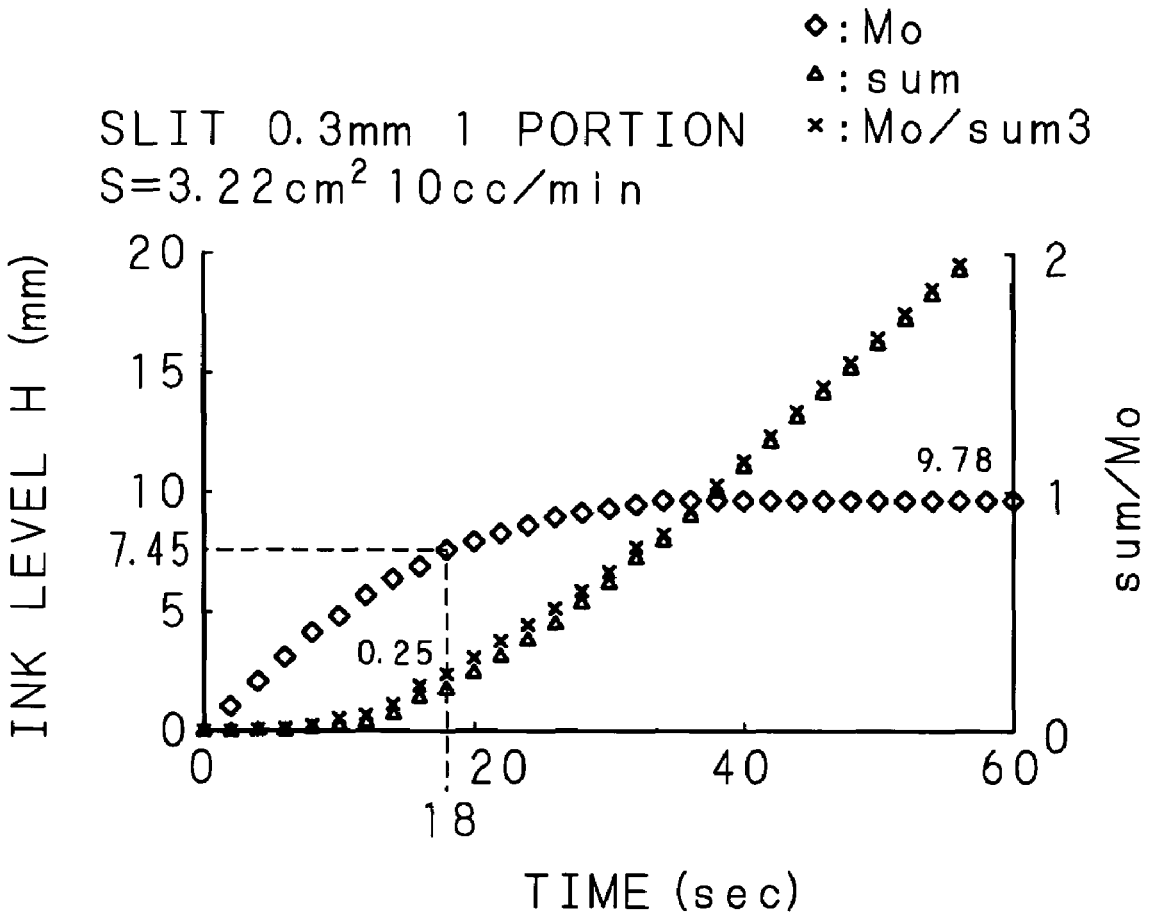
FIG. 8 is an explanatory view showing the relationship among the outflow amount, waste ratio and normalized level under the same condition of the recording apparatus of the present invention.
Figure 9:
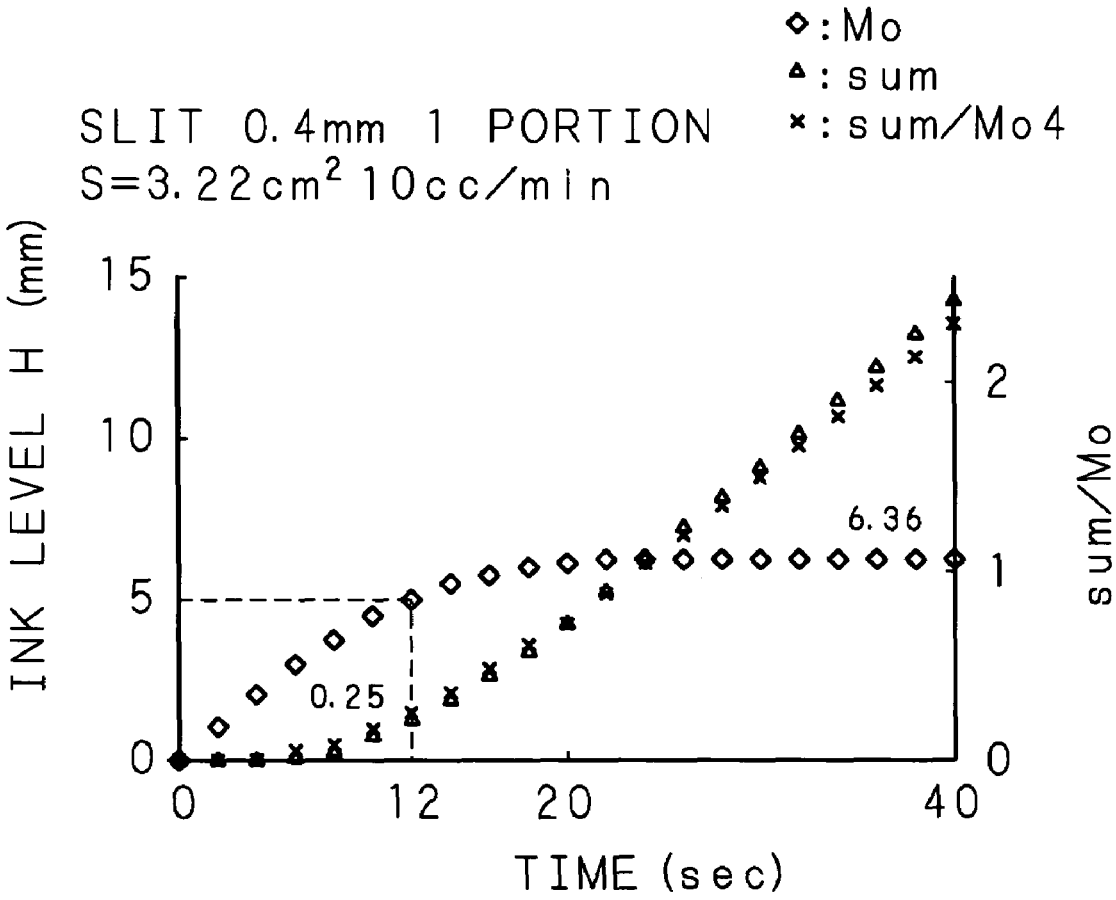
FIG. 9 is an explanatory view showing the relationship among the outflow amount, waste ratio and normalized level under the same condition of the recording apparatus of the present invention.

FIGS. 7, 8 and 9 are explanatory views showing the relationship among the outflow amount, waste ratio and normalized level under the same condition. FIGS. 7, 8 and 9 show the results of calculation (sum/Mo) as the waste ratio of ink consumed wastefully during filling, based on a value (Mo) indicating the amount of ink accumulated in the inlet-side space 7*a* when the ink is filled at the flow rate U and a value (sum) obtained by converting the accumulated amount of ink discharged to the suction device side via the outlet-side space 7*b* into an ink level in the inlet-side space.

As shown in FIGS. 7 through 9, the value varies depending on data settings such as the flow rate and the width dimension of the slit 73, the outflow amount (sum) and the waste ratio (sum/Mo) under the same condition show almost similar changes, and the values (Moc/Mos) obtained as the normalized level by finding an inflection point by approximation by broken line and dividing the ink level (Moc) at the inflection point by the saturation value (Mos) under the respective settings agree and are expressed as (Moc/Mos≈0.8) as shown in FIGS. 7 through 9. Further, the values of the waste ratio at the infection point also agree and are expressed as (sum/Mo≈0.26).

Figure 10:
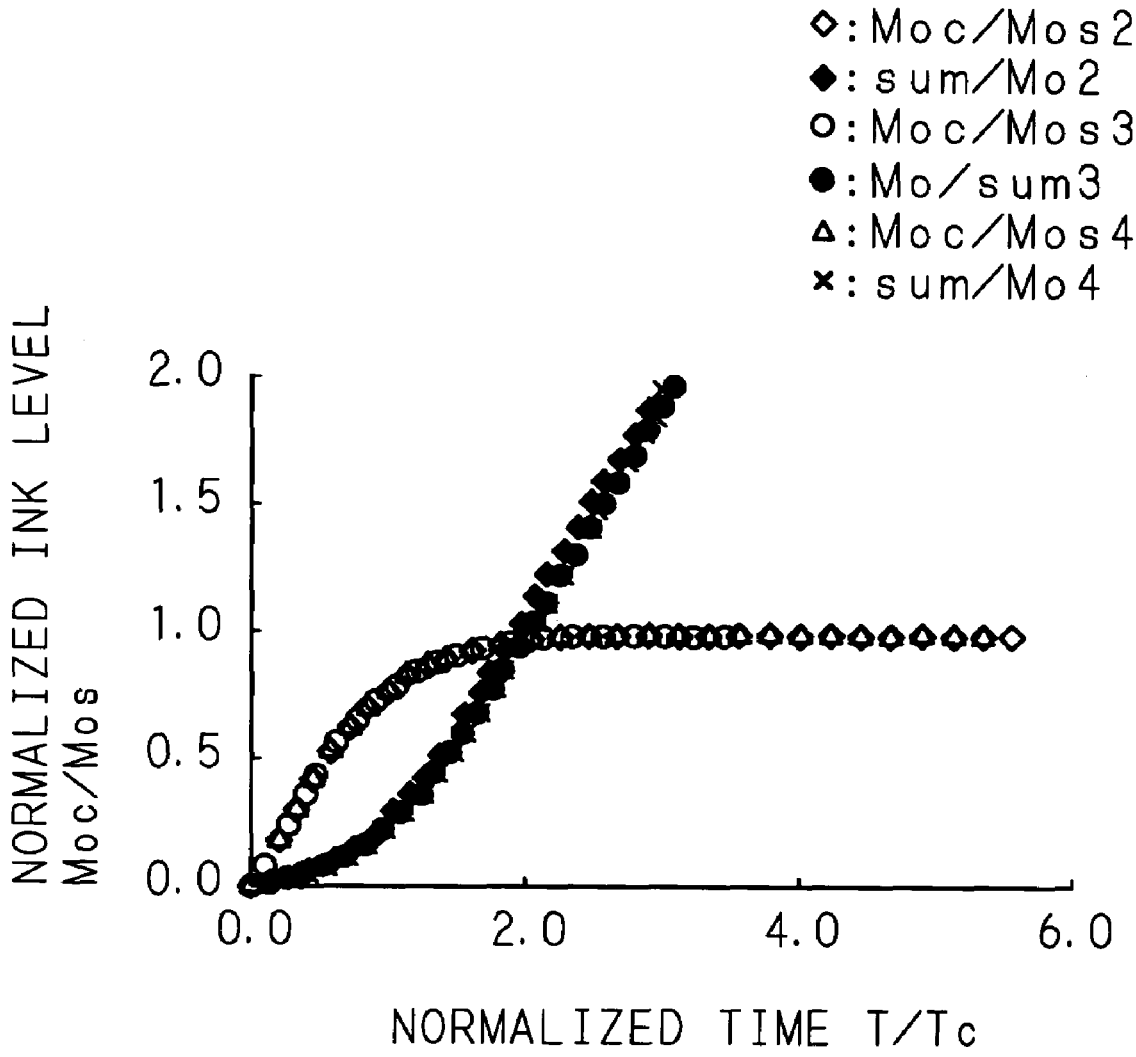
FIG. 10 is an explanatory view showing the relationship among the normalized time, normalized level, and waste ratio of the recording apparatus of the present invention.

FIG. 10 is an explanatory view showing the relationship among the normalized time, normalized level and waste ratio. The normalized time (T/Tc) obtained by dividing the elapsed time T by the time Tc at the inflection point based on the result is indicated on the abscissa, and the normalized level (Moc/Mos) and the waste ratio (Sum/Mo) of FIGS. 7 through 9 agree, and thus the normalization makes it possible to evaluate the filling characteristics without being influenced by the settings of parameters (see FIG. 10).

It was found that a value of about 80% of the saturation value was the inflection point and the end of filling needs to be set in the vicinity of the inflection point in order to fill as much as possible ink in an efficient manner. Therefore, as the conditions for the best mode, when the time at which suction for filling is stopped is Te, filling end time (Te/Tc)≈1, and, when the filling end time is set in the right region from the inflection point to ensure the ink level, $T/Tc=1.5$ sum/*Mo*=0.58

*Mo*/*Mos*=0.93, and an extremely large amount of ink is wasted in the region T/Tc>1.5.

As the condition for a better mode, the filling end time (Te/Tc)<1.5.

The waste ratio, normalized level, etc. shown in FIGS. 7 through 9 are indicated collectively in FIGS. 27 as Table 1.

By the way, the experiments were performed about specific widths, 0.1 mm, 0.2 mm and 0.3 mm, of the slit 73. As a result, for the slit width of 0.1 mm, operational instability due to adhesion of bubble was observed despite the slit configuration. Besides, it is practically difficult to form the slit integrally by using a synthetic resin, and, if the fact that the appropriate width is 0.2 to 0.3 mm and the mass production ability are taken into account, it is best to form a 0.3 mm slit 73 at the center in the width direction of the isolating member 72 so that the longitudinal direction thereof lies in the up-down direction.

Moreover, during printing, if the amount of ink to be supplied from the main-tank 2 to the sub-tank 7 is set to 0.5 cc/min, for example, it is possible to keep the ink level in the inlet-side space 7*a* and the ink level in the outlet-side space 7*b* at substantially the same value. In short, it is possible to achieve the state in which the ink is sufficiently supplied by the following supply of ink from the inlet-side space by the inflow resistance of flowing ink in the slit 73.

Figure 11A:
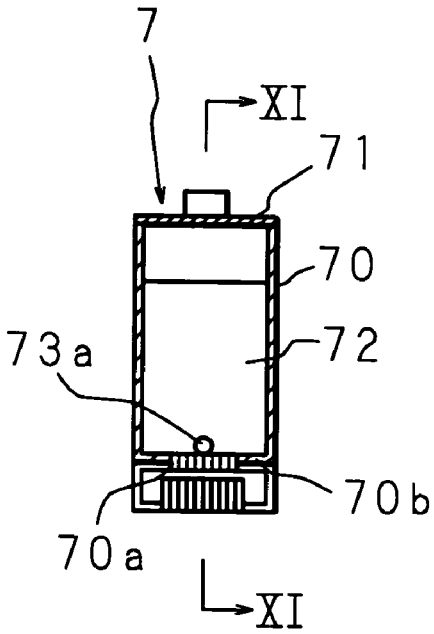
Figure 11B:
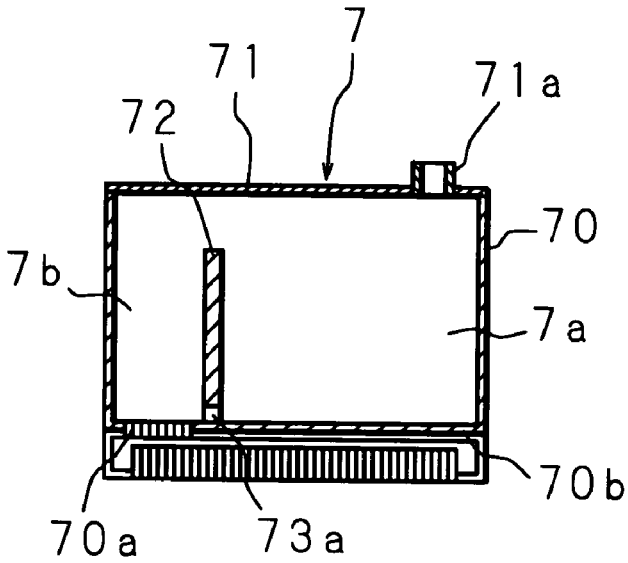

FIGS. 11A and 11B show another structure of the sub-tank, wherein FIG. 11A is an enlarged cross sectional view, and FIG. 11B is a cross sectional view cut along the XI—XI line of FIG. 11A. In the above-explained embodiment, although the inlet-side space 7*a* and the outlet-side space 7*b* are connected with the slit 73, the sub-tank is not limited to this structure, and, as shown in FIG. 11A and FIG. 11B, it is possible to connect the inlet-side space 7*a* and the outlet-side space 7*b* by an inflow channel made of a connection hole (hereinafter referred to as the connection hole) 73*a*. In this case, the isolating member 72 is made of a plate having substantially the same width dimension as the dimension between opposing side faces 70*c* and 70*c* in the sub-tank main body 70, and one connection hole 73*a* pierced through the lower part of the isolating member 72 in the thickness direction is provided. This connection hole 73*a* is formed in a size that allows inflow of ink when the ink level is present at the position of the connection hole 73*a*. Further, the connection hole 73*a* may be in either a circular shape (round shape), a rectangular shape or a net shape, and it may also be possible to form the connection hole 73*a* in various shapes such as a polygon, but, in FIG. 11A and FIG. 11B, the connection hole 73*a* is formed in a round shape. Moreover, the number of the connection hole 73*a* is not limited to one, and it is possible to form a plurality of connection holes 73*a*.

Here, the following description will explain the state of ink in the sub-tank 7 when the ink is supplied from the main-tank 2 to the sub-tank 7 during the initial ink filling (or in the state in which the ink in the sub-tank 7 runs out), for each of the structure in which the inflow channel is the slit 73 and the structure in which the connection hole 73*a* is a round hole. Here, in order to compare the effect of the structure in which the inflow channel is the slit 73 and the effect of the structure in which the connection hole 73*a* is a round hole under the same conditions, a slit and a round hole that produce the same head of equilibrium ink are used. Note that the slit and the round hole that produce the same head of equilibrium ink mean a slit and a round hole that cause the ink levels to have the same value when the amount of ink supplied to the inlet-side space 7*a* and the amount of ink supplied to the outlet-side space 7*b* at the time the ink in the sub-tank 7 is continuously discharged through the nozzle of the recording head are in equilibrium and the ink levels are in a stable state.

Figure 12:
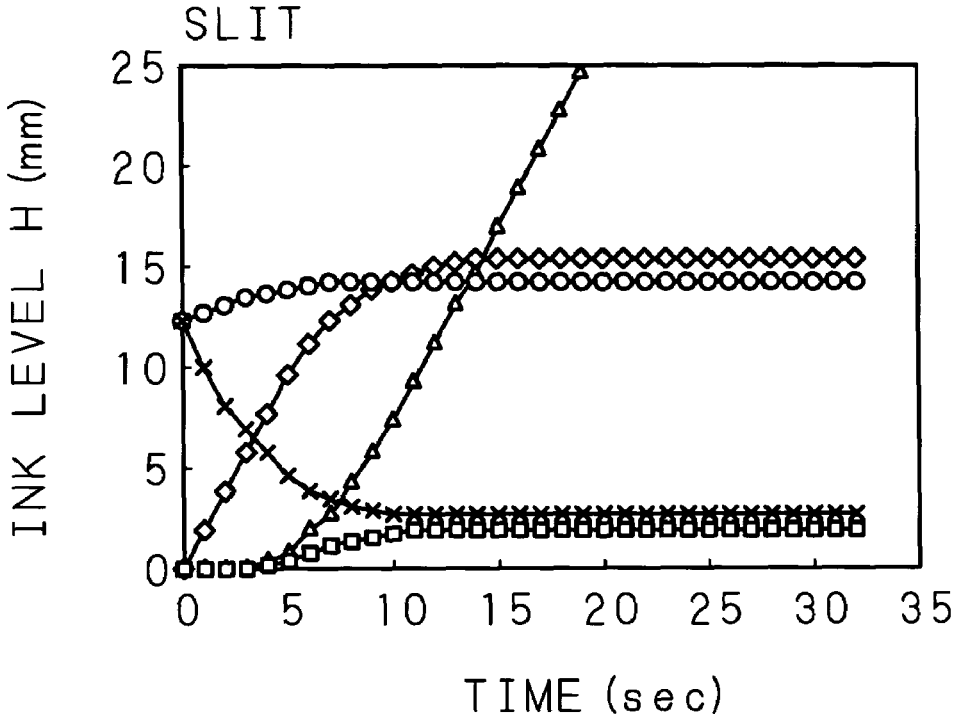
FIG. 12 is an explanatory view showing the state of the ink in the sub-tank when the inflow channel of the recording apparatus of the present invention is a slit.

FIG. 12 is an explanatory view showing the state of ink in the sub-tank 7 when the inflow channel is a slit. In FIG. 12, (Mo) indicates the ink level in the inlet-side space 7*a* when filling the ink against elapsed time; (O) indicates the inflow amount of ink into the outlet-side space 7*b* from the inlet-side space 7*a* when filling the ink; (sum) indicates the accumulated inflow amount to the outlet-side space 7*b* from the inlet-side space 7*a* when filling the ink; (Sm) indicates the ink level in the outlet-side space 7*b* when continuously discharging the ink from the initial ink level of 12 mm; and (Ms) indicates the ink level in the inlet-side space 7*a* when continuously discharging the ink. Note that when filling the ink, the ink is supplied from the main-tank 2 to the sub-tank 7 so that the ink level in the sub-tank 7 is 15 mm in an equilibrium state (this is also the same for FIG. 13 mentioned below). Besides, as the initial ink level when continuously discharging the ink, the ink level of 12 mm is illustrated.

As a result, when filling the ink, since the ink is supplied to the inlet-side space 7*a* from the ink supply opening 71*a* provided in the upper part of the inlet-side space 7*a*, the ink level (Mo) in the inlet-side space 7*a* promptly increases. Regarding the inflow amount (O) of ink to the outlet-side space 7*b* from the inlet-side space 7*a* when filling the ink, the inflow amount is extremely small at the initial stage, and is fixed with the elapse of a certain time.

Moreover, when continuously discharging the ink, the ink level (Sm) in the outlet-side space 7*b* during the continuous discharge decreases with the supply of ink to the recording head 1*a*, and is stabilized on and after the time at which the amount of ink supplied to the recording head 1*a* from the outlet-side space 7*b* and the amount of ink supplied to the outlet-side space 7*b* from the inlet-side space 7*a* come to equilibrium. On the other hand, regarding the ink level (Ms) in the inlet-side space 7*a* during the continuous discharge, since the inflow resistance of flowing ink in ink supply path from the main-tank 2 to the inlet-side space 7*a* through the tube 11 or the like is made sufficiently small, after the ink level is increased by the supply of same amount (0.5 cc/min) of ink from the main-tank 2 to the inlet-side space 7*a* following the continuous discharge from the head (0.5 cc/min), it is stabilized at a certain level (about 14 mm) on and after the time at which the amount of ink supplied to the outlet-side space 7*b* comes to equilibrium.

Figure 13:
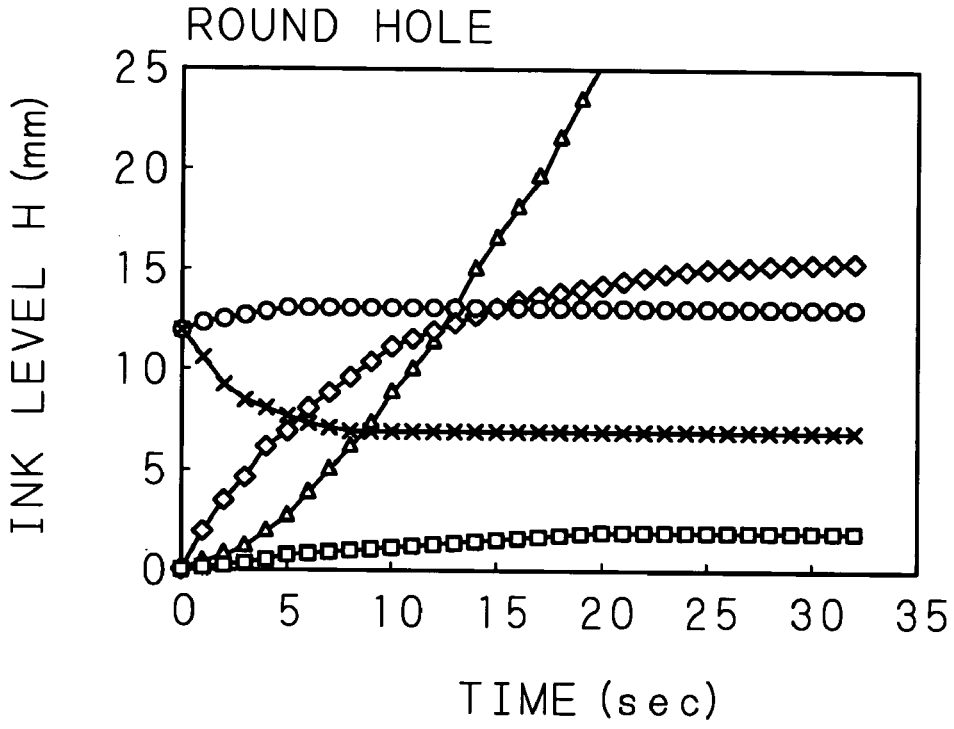
FIG. 13 is an explanatory view showing the state of the ink in the sub-tank when the inflow channel of the recording apparatus of the present invention is a round hole.

FIG. 13 is an explanatory view showing the state of ink in the sub-tank when the inflow channel is a round hole. In FIG. 13, (Mo') indicates the ink level in the inlet-side space 7*a* when filling the ink against elapsed time; (O) indicates the inflow amount of ink into the outlet-side space 7*b* from the inlet-side space 7*a* when filling the ink; (sum') indicates the accumulated inflow amount to the outlet-side space 7*b* from the inlet-side space 7*a* when filling the ink; (Sm) indicates the ink level in the outlet-side space 7*b* when continuously discharging the ink from the initial ink level of 12 mm; and (Ms) indicates the ink level in the inlet-side space 7*a* when continuously discharging the ink.

As a result, when filling the ink, since the ink is supplied to the inlet-side space 7*a* from the ink supply opening 71*a* provided in the upper part of the inlet-side space 7*a*, the ink level (Mo') in the inlet-side space 7*a* promptly increases. Regarding the inflow amount (O) of ink to the outlet-side space 7*b* from the inlet-side space 7*a* when filling the ink, the inflow amount is extremely small at the initial stage and is then fixed at a certain value with the elapse of a certain time.

Here, in the case where the connection hole 73*a* is a round hole, the increase in the ink level (Mo') in the inlet-side space 7*a* at the initial stage is smaller compared to the case where the inflow channel is the slit 73 (see FIG. 12). The reason for this is that the inflow amount (O) of ink to the outlet-side space 7*b* from the inlet-side space 7*a* at the initial stage is greater when the inflow channel is the round hole than when the inflow channel is the slit 73. This is due to the function of the slit that causes the flow rate to be proportional to the square of the applied head of ink as compared to the case of the round hole where the flow rate is proportional to the applied head of ink, namely, ink level raised to the power of 1.

Further, when continuously discharging the ink, the ink level (Sm) in the outlet-side space 7*b* during the continuous discharge decreases with the supply of ink to the recording head 1*a* and is then stabilized. On the other hand, regarding the ink level (Ms) in the inlet-side space 7*a* during the continuous discharge, since the ink is supplied from the main-tank 2 to the inlet-side space 7*a* at a flow rate (0.5 cc/min) following the continuous discharge from the head, the ink level (Ms) is stabilized at a certain level (about 13 mm).

Here, a comparison is made with the case where the inflow channel is the slit 73 (see FIG. 12). The degree of decrease in the ink level in the outlet-side space 7*b* during the continuous discharge is larger in the case of the slit 73, and the equilibrium ink level (Sm) is 2.7 mm in the case of the slit 73 as compared to 6.8 mm in the case of the round hole, but, since the ink level (Sm) is in equilibrium at 2.7 mm and within the range of stable supply, this value is not regarded as a problem.

Figure 14:
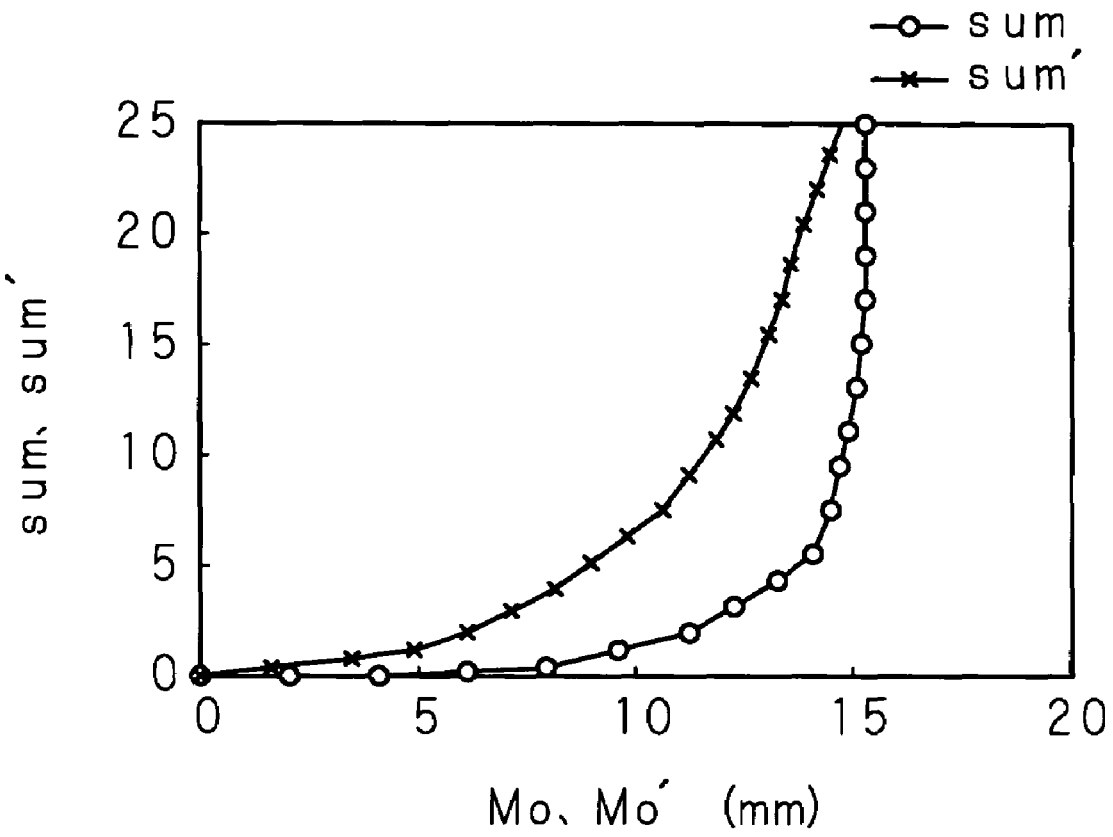
FIG. 14 is an explanatory view of the accumulated inflow amount to the outlet-side space when comparing the case where the inflow channel of the recording apparatus of the present invention is a slit and the case where the inflow channel is a round hole.

FIG. 14 is an explanatory view of a comparison in the accumulated inflow amount to the outlet-side space between the case where the inflow channel is the slit and the case where the inflow channel is the round hole. As shown in FIG. 14, according to the comparison between the accumulated inflow amounts (sum and sum') to the outlet-side space 7*b* from the inlet-side space 7*a* during ink filling in the cases of the slit 73 and the round hole, even when the ink level (Mo) in the inlet-side space 8*a* during the filling is gradually increased by the inflow of ink, the value of the accumulated inflow amount (sum and sum') is smaller in the case of the slit 73 compared to the round hole. In short, it is shown that the slit 73 can reduce the amount of wasted ink that is discharged from the nozzle of the recording head 1*a* through the outlet-side space 7*b* without being effectively filled in the inlet-side space 7*a* when filling the ink.

Figure 15:
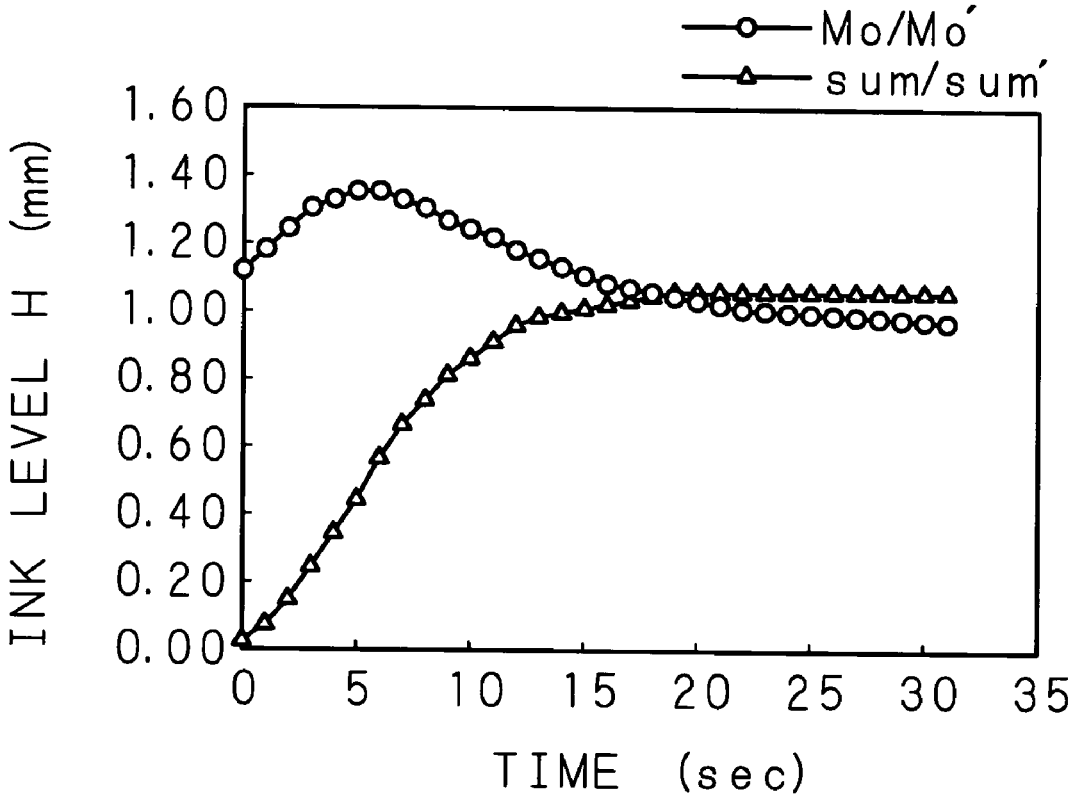
FIG. 15 is an explanatory view showing the ratio of ink level and the ratio of accumulated inflow amount in the cases of the slit and the round hole, against elapsed time after starting to fill the recording apparatus of the present invention.

FIG. 15 is an explanatory view showing the ratio of ink level and the ratio of accumulated inflow amount in the cases of slit and round hole against elapsed time when filling is started. In FIG. 15, the ratio of ink level is (Mo/Mo') in the inlet-side space 7*a*, and the ratio of accumulated inflow amount is the ratio of accumulated inflow amount to the outlet-side space 7*b* from the inlet-side space 7*a* (sum/sum').

It can be understood from FIG. 15 that, at the initial stage of filling the ink, the ink level (Mo) in the inlet-side space 7*a* in the case of the slit 73 is higher than the ink level (Mo') in the inlet-side space 7*a* in the case of the round hole. Moreover, at the initial stage of filling the ink, the accumulated inflow amount (sum) to the outlet-side space 7*b* from the inlet-side space 7*a* in the case of the slit 73 is smaller than the accumulated inflow amount (sum') to the outlet-side space 7*b* from the inlet-side space 7*a* in the case of the round hole.

As described above, when the slit 73 and the round hole are compared, in the initial stage of filling the ink and the continuous discharge, the slit 73 can make the inflow of ink to the outlet-side space 7*b* from the inlet-side space 7*a* smaller than the round hole. Accordingly, when the gas accumulated in the sub-tank 7 is removed, the amount of ink sucked and removed can be made smaller and an efficient gas removal operation can be performed by providing the slit 73 as the inflow channel than by providing the round hole.

By the way, when removing the gas accumulated in the sub-tank 7, the ink level in the outlet-side space 7*b* is detected by the detector 13, and the suction device is operated based on the detected ink level. Therefore, the ink level can be obtained more accurately than by finding the ink level in the outlet-side space 7*b* from the ink discharge time or the number of times of ink discharge, and it is possible to reduce the amount of ink in the outlet-side space 7*b* which is sucked together with gas to a minimum necessary amount.

Figure 16A:
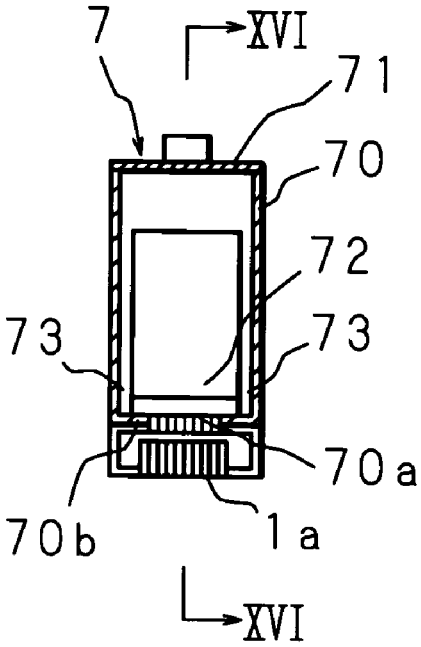
Figure 16B:
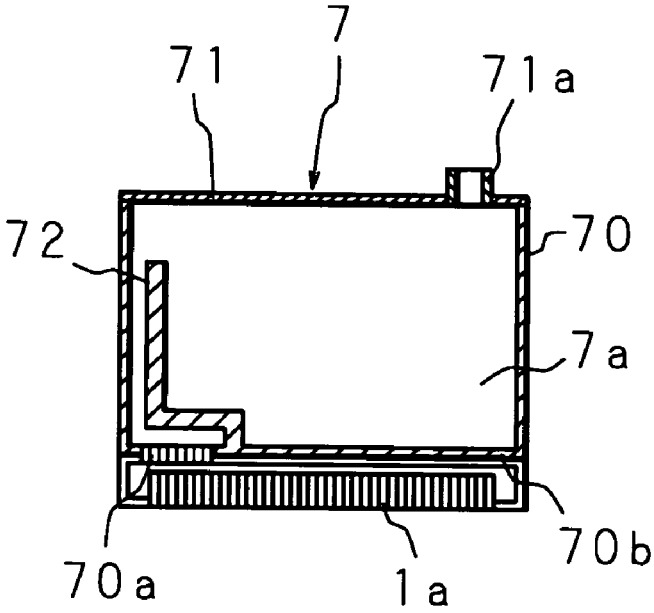

FIGS. 16A and 16B show still another structure of the sub-tank, wherein FIG. 16A is an enlarged cross sectional view, and FIG. 16B is a cross sectional view cut along the XVI—XVI line of FIG. 16A. In the above explanation, although the shape of the isolating member 72 is formed as shown in FIGS. 2A and 2B, the isolating member 72 is not limited to this shape and may be formed, for example, in a bent shape as shown in FIGS. 16A and 16B. By forming the isolating member 72 in the shape shown in FIGS. 16A and 16B, it is possible to reduce the capacity of the outlet-side space 7*b* compared to that shown in FIGS. 2A and 2B, and further reduce the amount of ink sucked and removed and achieve an efficient gas removal operation.

Figure 17:
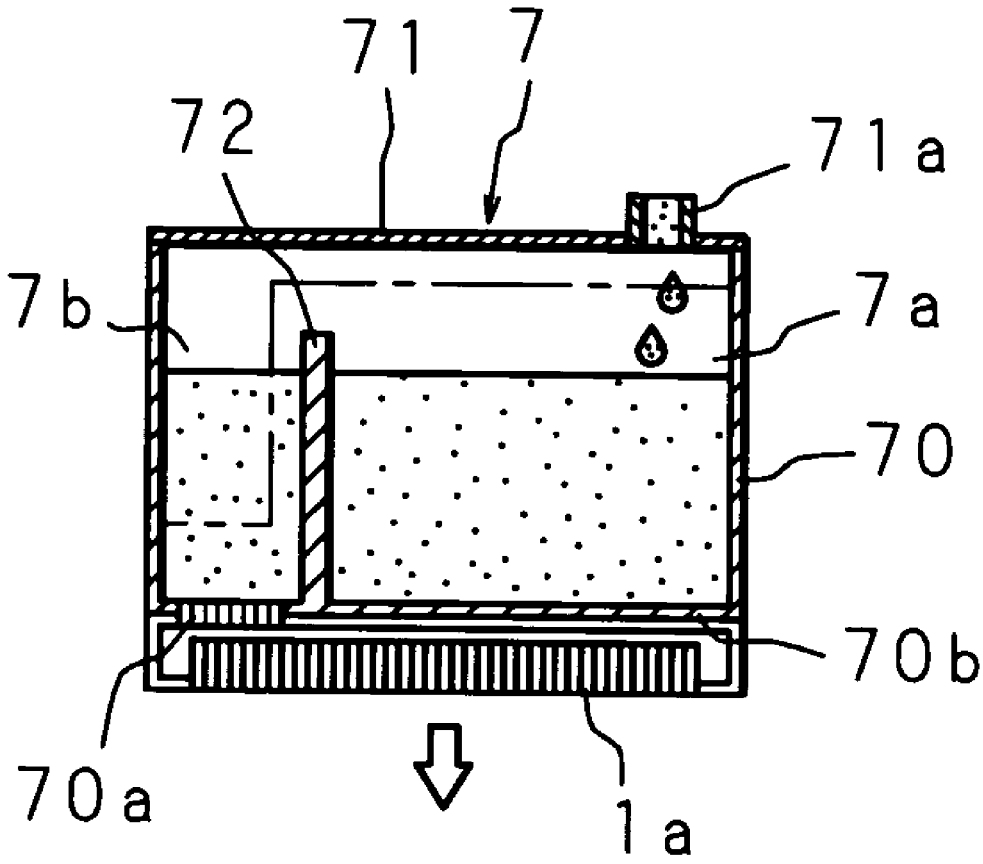
FIG. 17 is an explanatory view showing the state of the ink in the sub-tank when continuously discharging the ink in the recording apparatus of the present invention.

FIG. 17 is an explanatory view showing the state of ink in the sub-tank when continuously discharging the ink. When continuously discharging the ink, since the pressure in the sub-tank 7 is reduced simultaneously with the discharge, the ink is supplied from the main-tank 2 to the inlet-side space 7*a* of the sub-tank 7. In this case, as shown in FIG. 17, the time at which the ink level in the inlet-side space 7*a* and the ink level in the outlet-side space become substantially the same level is found.

First, an equivalent model of the inflow channel is developed. In an electric circuit, expression (1) below is established among voltage (E [V]), current (I [A]), and resistance (R [Ω]).

$$E=I\times R \tag{1}$$

Moreover, expression (2) below is established among current (I [A]), voltage (E [V]), and capacitor capacity (C [F]).

$$C=\{\int Idt\}/E \tag{2}$$

On the other hand, expression (3) below is established among the pressure (P [Pa]) of the head of ink in the outlet-side space 7*b* in the sub-tank 7, the volume (V [$m^3$]) of ink in the outlet-side space 7*b* of the sub-tank 7, and the base area (S [$m^2$]) of the outlet-side space 7*b* of the sub-tank 7.

$$P=(V/S)\cdot\gamma\cdot(9.8\times10^3) \tag{3}$$

Here, if the voltage (E [V]) is replaced by the pressure (P [Pa]) and the current (I [A]) is replaced by the volume velocity (U [$m^3$/s]), then expression (2) above is rewritten to expression (4) below.

$$C=\{\int Udt\}/P \quad (4)$$

Next, if P is eliminated from expressions (3) and (4) above, then expression (5) below is given.

$$(V/S)\cdot\gamma\cdot(9.8\times10^3)=\{\int Udt\}/C \quad (5)$$

Further, since ∫Udt=V, if this relational expression is substituted into expression (5) above, then expression (6) below is given.

$$C=S/\{\gamma\cdot(9.8\times10^3)\} \quad (6)$$

Accordingly, the time constant (C×R) of this inflow channel corresponding to the time constant (C×R) of the electric circuit is given by expression (7) below.

Here, $R=P/U=[N/m^2]/[m^3/s]=[N\cdot s/m^5]$.

$$C\cdot R=R\cdot S/\{\gamma\cdot(9.8\times10^3)\} \quad (7)$$

In short, the time at which the ink level in the inlet-side space 7*a* and the ink level in the outlet-side space become substantially the same level is the time constant given by expression (7) above. Therefore, by keeping the relationship of expression (8) below between the time (To) until the next ink discharge and the above-mentioned time constant ($R\cdot S/\{\gamma\cdot(9.8\times10^3)\}$), the next ink discharge can be performed in the state in which the ink level in the inlet-side space 7*a* and the ink level in the outlet-side space are substantially the same level. It is thus possible to perform stable ink supply to the outlet-side space 7*b*.

$$R\cdot S/\{\gamma\cdot(9.8\times10^3)\}<To \quad (8)$$

Note that in the case where the inflow channel is in the shape of a round hole (tube), the pressure (P [Pa]) in the sub-tank 7 is given by expression (9) below using the viscosity (μ [Pa·s]) of ink, the channel length (L [m]) of the inflow channel, and the diameter (d [m]) of the inflow channel.

$$P=128\mu\cdot L\cdot U/(\pi\cdot d^4) \quad (9)$$

Accordingly, ink inflow resistance R is given by expression (10) below.

$$R=128\mu\cdot L/(\pi\cdot d^4) \quad (10)$$

On the other hand, in the case of the slit 73, if the width in the short side direction (X direction) of the aperture of the slit 73 is g and the long side direction (Y direction) is infinity or sufficiently long, then the volume velocity (U [$m^3/s$]) per unit length in the long side direction (Y direction) is given by expression (11) below.

$$U=g^3\cdot P/(12\cdot\mu L) \quad (11)$$

Moreover, since ink inflow resistance r per unit width in the long side direction (Y direction) is obtained by dividing the pressure P by the volume velocity (U [$m^3/s$]), it is given by expression (12) below.

$$r=12\cdot\mu\cdot L/g^3 \quad (12)$$

In the arrangement of the slit 73 (the long side direction lies in the up-down direction) shown in this embodiment, since the pressure applied to the slit 73 changes depending on the length of the slit 73, if the height of the head of ink is H (m), then the flow rate in the entire slit is given by $$U=\int_0^H\{a\cdot(H-h)\}dh=a\cdot H^2/2 \quad (13)$$

Here, $a=\{\gamma(9.8\times10^3)/r\}$; and γ is specific gravity of ink. If $\gamma\cdot H\cdot(9.8\times10^3)=P$, then $$U=P/(2\cdot r/H) \quad (14).$$

Accordingly, ink inflow resistance $R_H$ in the slit with the head H of ink is given by expression (15) below.

$$R_H=2\cdot r/H \quad (15)$$

In order to effectively use the volume of the sub-tank 7, the capacity of the inlet-side space 7*a* is made larger than the capacity of the outlet-side space 7*b*, and, if the capacity ratio is 1:n and the ink level just after filling is Ho, then the ink level Hs after reaching equilibrium is given by $$Hs=Ho\cdot n/(1+n).$$

For example, when n=4, equilibrium is reached at the level of 4/5.

If the change in level until the equilibrium is reached is taken into account for the ink flow resistance R=(2·r/H) of the slit given by expression (15), the average head height until equilibrium is reached is Ho·(0.5+n)/(1+n), and slit resistance Rs is given by $$Rs=[2\cdot r/\{Ho\cdot(0.5+n)/(1+n)\}] \quad (16).$$

The ink level changes until equilibrium is reached, but since the level of change is small, it is possible to understand the outline of transient phenomenon to equilibrium from the slit resistance Rs at the average head height until equilibrium is reached after filling.

Thus, the transient phenomenon to equilibrium after filling can be found by substituting the slit resistance Rs for the ink inflow resistance R in expression (7). Similarly, the condition of stable supply of ink to the outlet-side space 7*b* can be known by substituting Rs for R in expression (8). Note that if the capacities in the inlet-side space 7*a* and the outlet-side space 7*b* are Ca and Cb, respectively, the composite capacity is Cs=Ca·Cb/(Ca+Cb). However, in order to effectively use the volume of ink tank, the capacity ratio 1:n is set to a large value, and Cs≈Cb. Therefore, the above study was made by simplifying the composite capacity as Cs≈Cb, but there was no practical problem.

FIGS. 18 through 21 and FIGS. 22A through 22C are partial cross sectional views showing other structures of the inflow channel. In the above-explained embodiment, although the slits 73 are provided as the inflow channels between both ends in the width direction of the isolating member 72 and the opposing side faces in the sub-tank main body 70, it is also possible to construct the slit 73 as shown in FIGS. 18 through 21 and FIGS. 22A through 22C.

Figure 18:
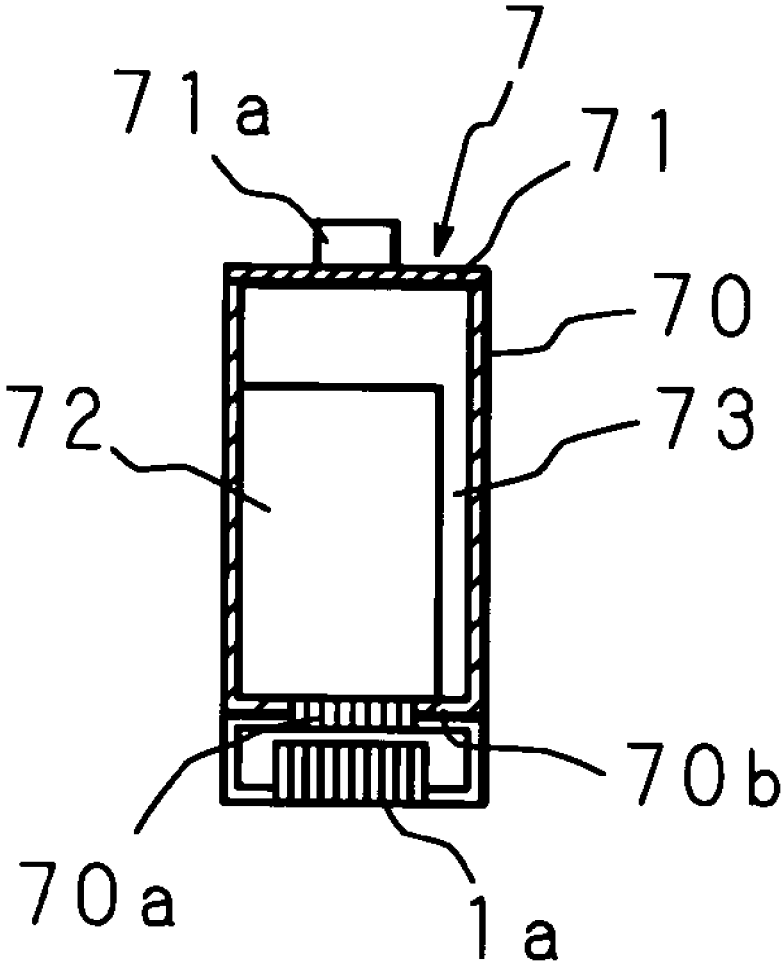
FIG. 18 is a partial cross sectional view showing other structure of the inflow channel of the recording apparatus of the present invention.
Figure 19:
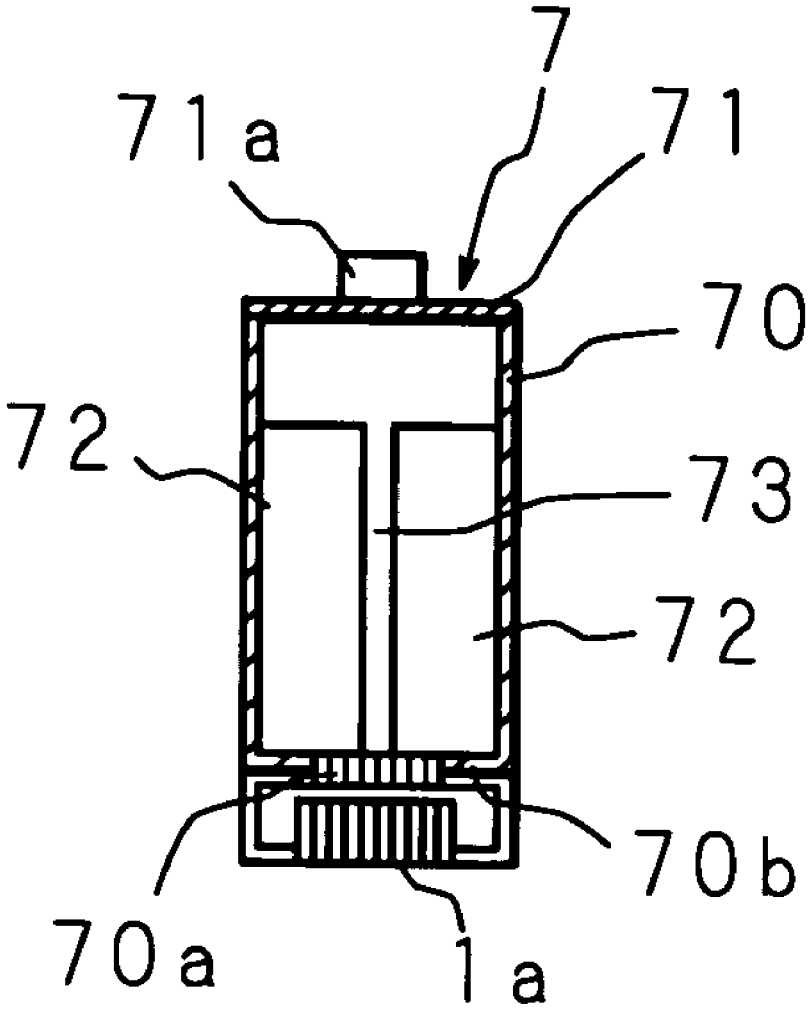
FIG. 19 is a partial cross sectional view showing other structure of the inflow channel of the recording apparatus of the present invention.

FIG. 18 shows the slit 73 provided as the inflow channel between one of the opposing side faces 70*c* in the sub-tank main body 70 and one end in the width direction of the isolating member 72 with a width dimension smaller than the dimension between the opposing side faces 70*c*, 70*c* in the sub-tank main body 70. FIG. 19 shows the slit 73 provided as the inflow channel at the center in the width direction of the isolating member 72.

Figure 20:
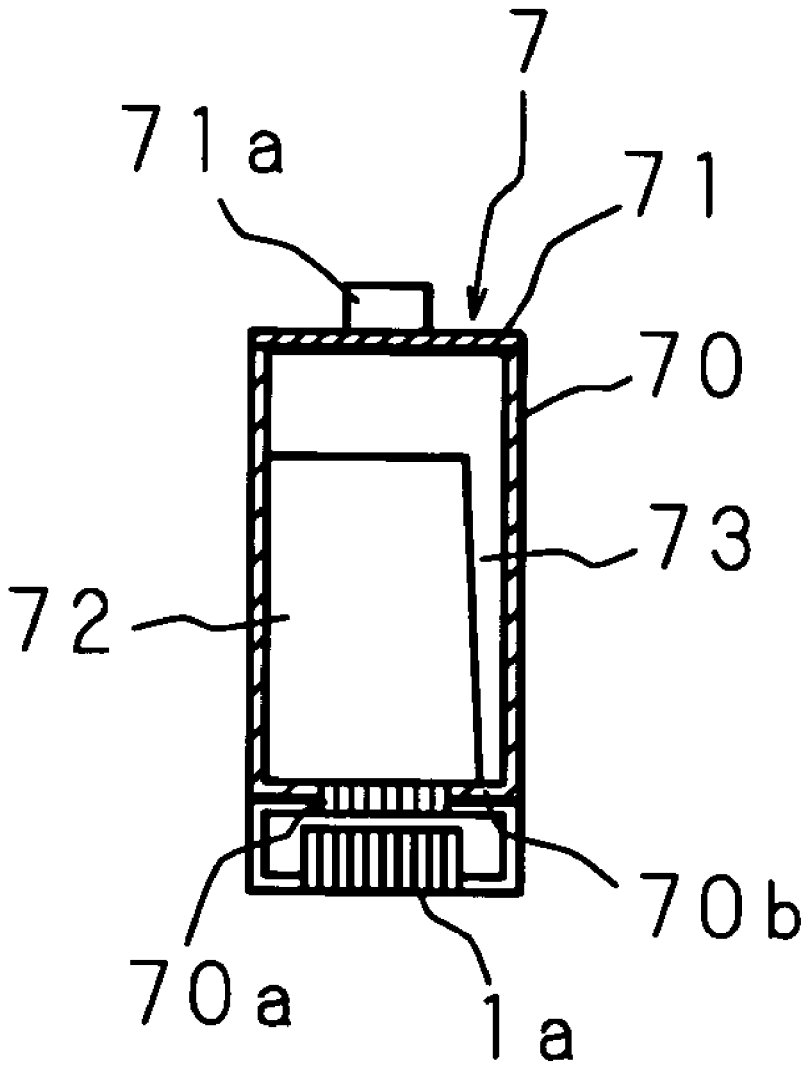
FIG. 20 is a partial cross sectional view showing other structure of the inflow channel of the recording apparatus of the present invention.
Figure 21:
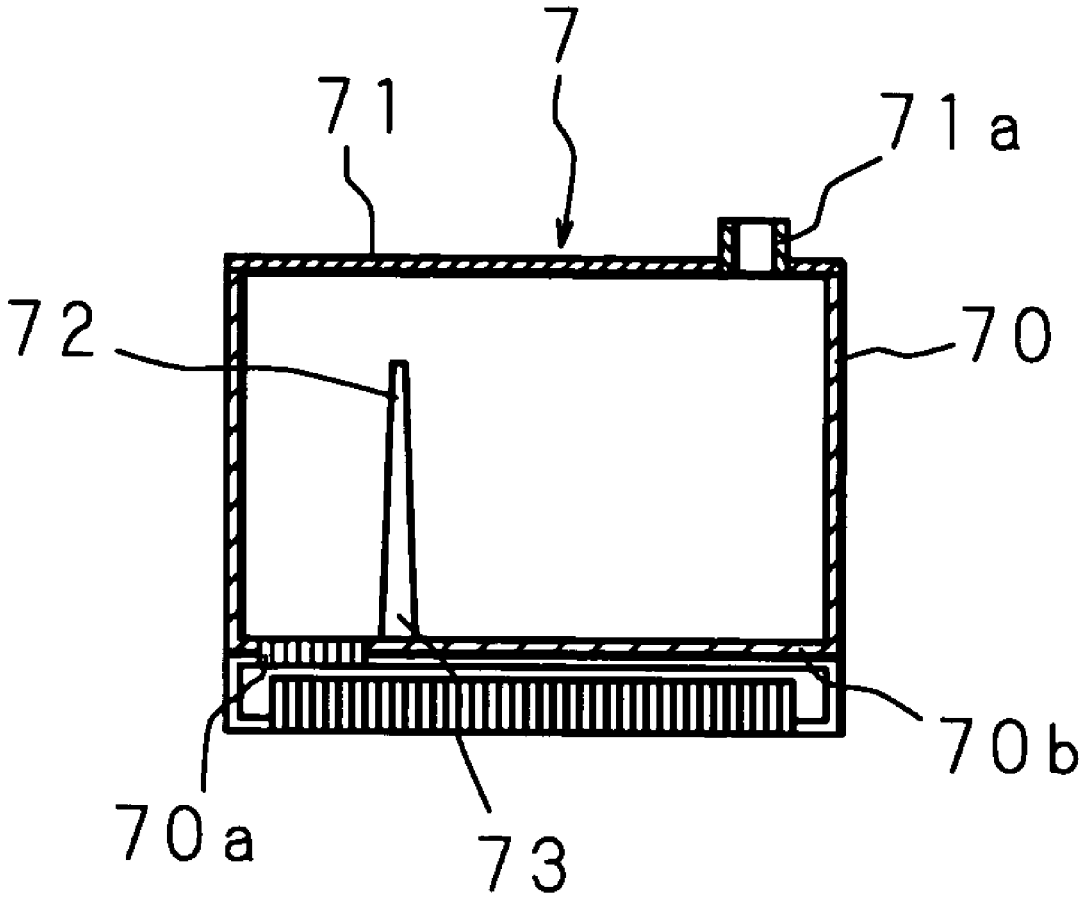
FIG. 21 is a partial cross sectional view showing other structure of the inflow channel of the recording apparatus of the present invention.

Further, FIG. 20 shows the slit 73 provided as the inflow channel whose width dimension is shorter on the lower side of the sub-tank 7 and longer on the upper side. FIG. 21 shows the slit 73 as the inflow channel which is designed so that the distance from the start end to the terminal end of the slit 73 is longer on the lower side of the sub-tank 7 and shorter on the upper side. According to FIGS. 20 and 21, the inflow amount of ink per unit time on the lower side can be made smaller than the inflow amount of ink on the upper side, and the inflow amount of ink per unit time on the upper side can be made larger than the inflow amount of ink on the lower side.

Figure 22A:
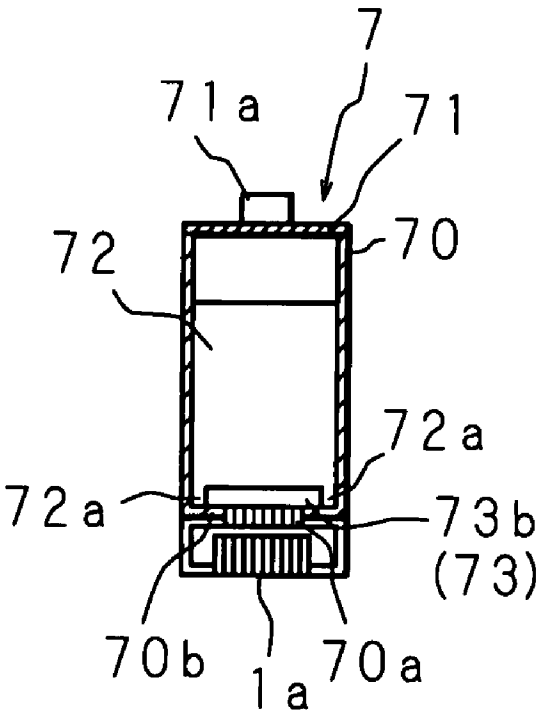
FIGS. 22A, 22B and 22C are partial cross sectional views showing other structures of the inflow channel of the recording apparatus of the present invention.
Figure 22B:
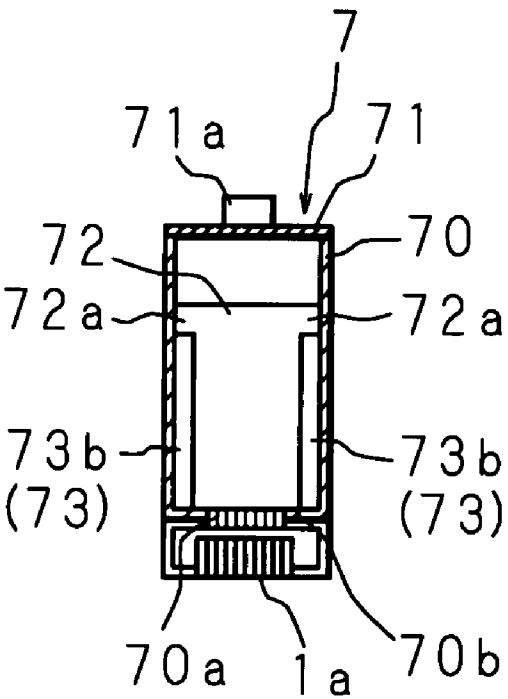
Figure 22C:
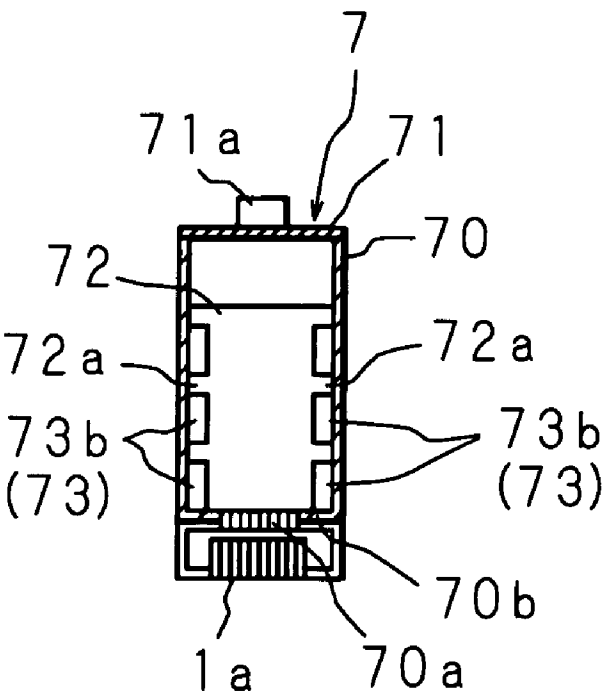
Figure 23:
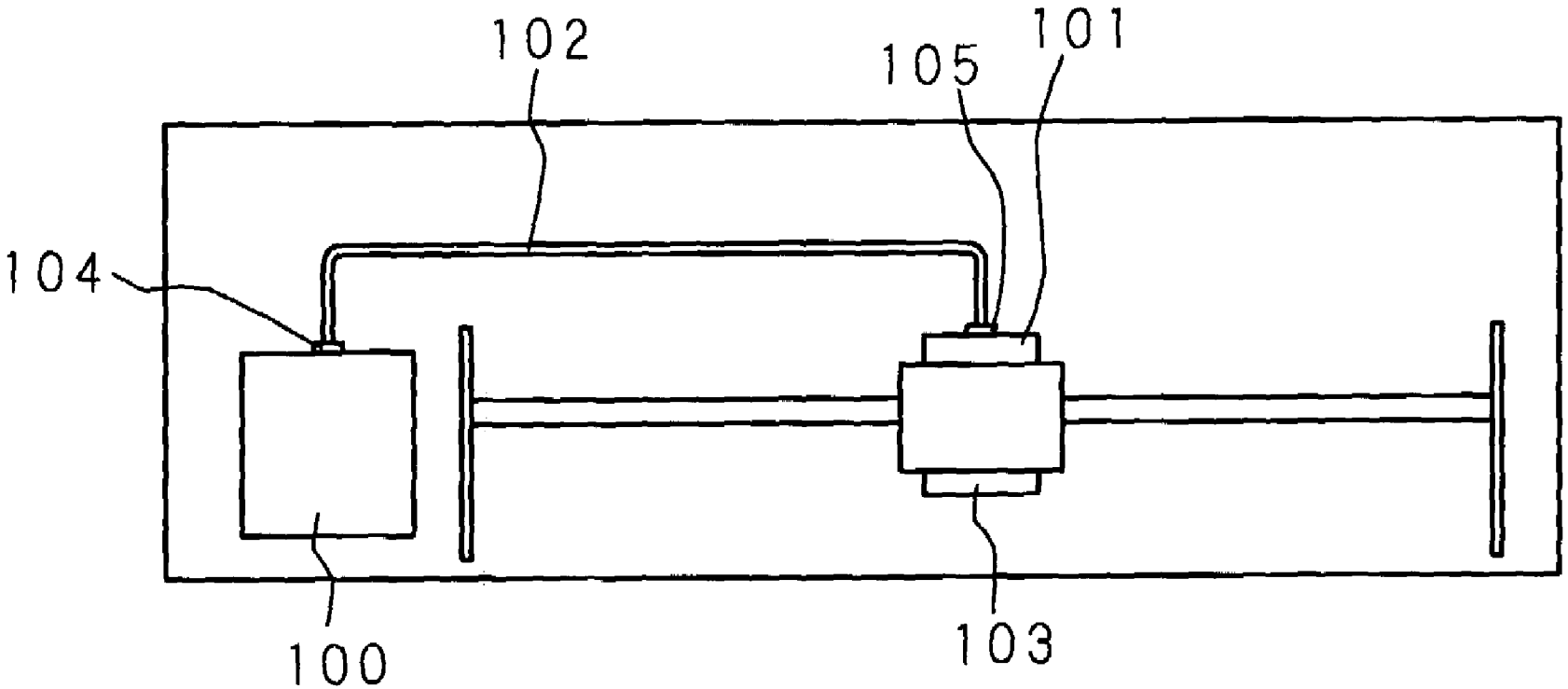
FIG. 23 PRIOR ART
FIG. 23 is a front view showing one example of a conventional recording apparatus.
Figure 24:
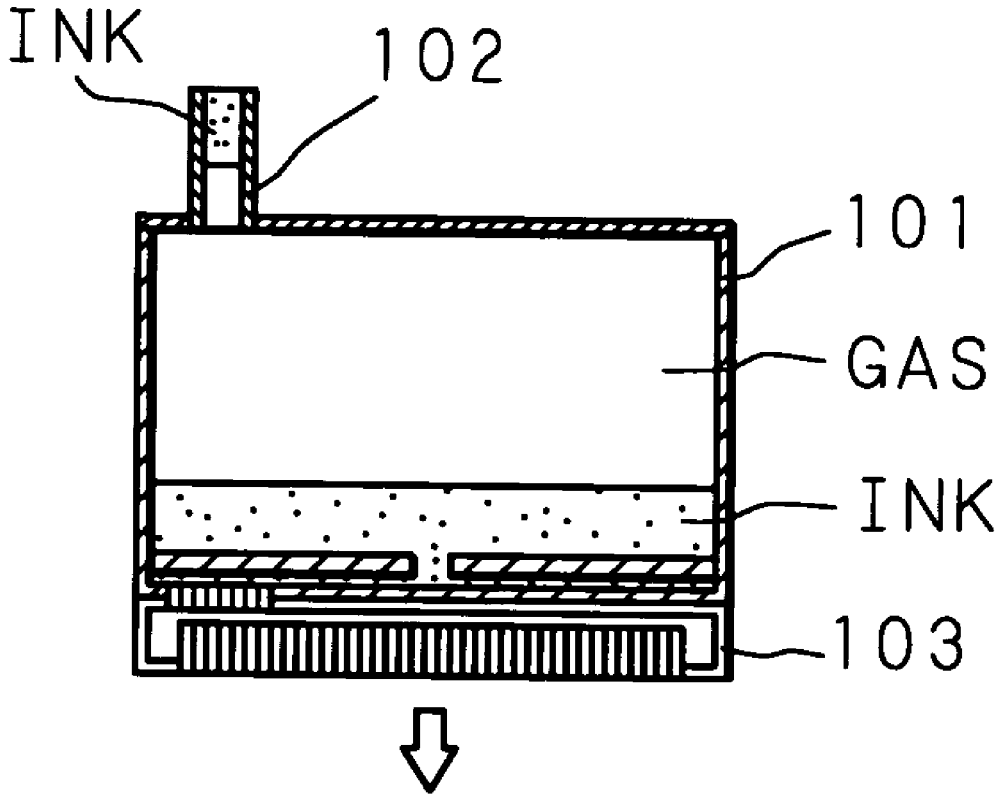
FIG. 24 PRIOR ART
FIG. 24 is a cross sectional view showing the state in which gas is accumulated in the sub-tank of the conventional recording apparatus.
Figure 25:
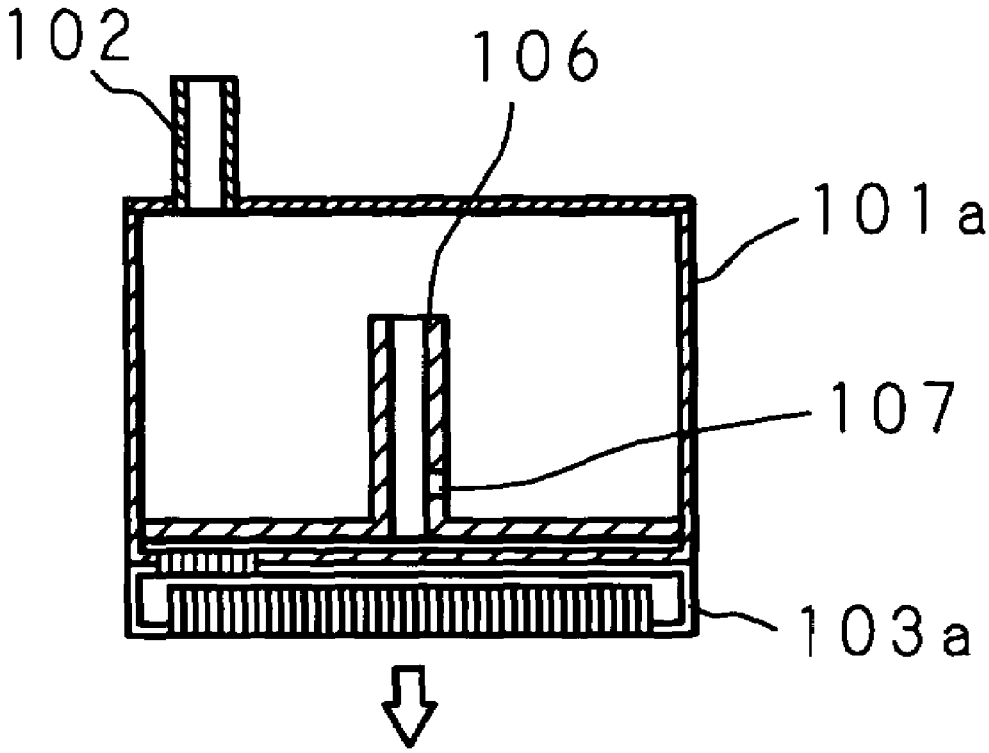
FIG. 25 PRIOR ART
FIG. 25 is a cross sectional of a conventional recording apparatus capable of removing the gas accumulated in the sub-tank.
Figure 26:
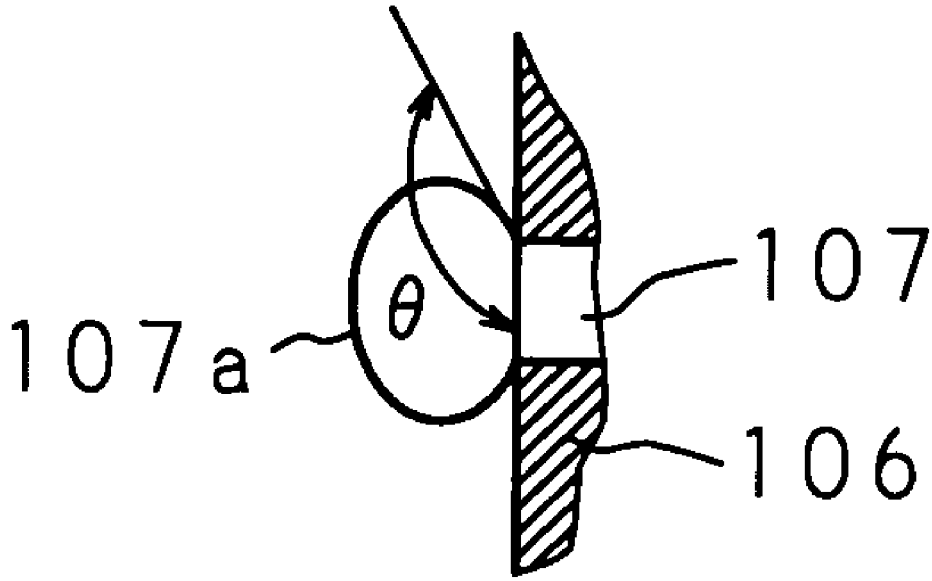
FIG. 26 PRIOR ART
FIG. 26 is an enlarged cross sectional view of a meniscus section in the sub-tank of the conventional recording apparatus.

Besides, in FIGS. 22A through 22C, a recess to be the inflow channel, in other words, a recess 73*a* functioning as a slit 73, is provided in the peripheral surface of the isolating member 72 that is formed as a separate body from the sub-tank main body 70. This recess 73*b* may be the lower-side face of the isolating member 72 as shown in FIG. 22A, or one end face or both end faces in the width direction of the isolating member 72 as shown in FIG. 22B, or a plurality of recesses 73*b* may be provided in one end face or both end faces in the width direction of the isolating member 72 so that they are separated from each other in the up-down direction as shown in FIG. 22C. Each of the isolating members 72 in FIGS. 22A through 22C is formed integrally with the lid body 71, for example. In FIGS. 22A through 22C, since a non-slit section 72*a* of the peripheral surface of the isolating member 72 can be brought into contact with the inner side of the sub-tank main body 70, it is possible to increase the precision of the width dimension of the slit 73 on the basis of the non-slit section 72*a* as compared to FIGS. 2A and 2B, and it is possible to increase the strength of fixing the isolating member 72 to the sub-tank main body 70 as compared to FIGS. 2A and 2B.

Thus, although the slit 73 as the inflow channel is provided between the opposing side faces in the sub-tank main body 70, it may be possible to provide the slit 73 in the middle of the width direction of the isolating member 72 so that the longitudinal direction lies in the up-down direction or the horizontal direction. Alternatively, a plurality of slits 73 may be provided on a line. Further, the slit 73 may be formed in the inside surface of the sub-tank main body 70 instead of the isolating member 72. In this case, for example, the slit 73 is formed by recessing a part of the sub-tank main body 70 facing the isolating member 72, in the form of a line with a width dimension larger than the thickness of the isolating member 72.

Besides, in the case where a plurality of connection holes 73*a* are provided as the inflow channels, the aperture configuration of each of the connection holes 73*a* can be set in various ways. Moreover, even when a part of connection hole 73*a* is clogged with a bubble adhering to the connection hole 73*a*, it is possible to allow the ink to flow into the outlet-side space 7*b* from the inlet-side space 7*a*.

According to the present invention, as described in detail above, since the recording apparatus comprises the isolating member for separating the inside of the sub-tank into the inlet-side space and the outlet-side space in the horizontal direction, and the inflow channel for increasing the ink level in the inlet-side space while allowing the ink in the inlet-side space to flow into the outlet-side space from the isolating member, the amount of ink in the outlet-side space which is sucked together with gas can be reduced without making the inflow channel extremely small nor making the thickness of the isolating member extremely thin. In addition, since there is no need to form an extremely small inflow channel and an extremely thin isolating member, the manufacturability of the sub-tank can be improved and the cost of the recording apparatus can be reduced.

Moreover, according to the present invention, the inflow channel has a size allowing inflow of ink when the ink level is present at the position of the inflow channel, and a surface connected to the terminal end of the inflow channel is made of a material that is wettable by the ink, and therefore it is possible to shorten the time taken for the ink level in the inlet-side space and the ink level in the outlet-side space to be in equilibrium after the suction and removal of gas.

Besides, according to the present invention, since the isolating member is in the form of a plate, it is possible to easily set the inflow amount of ink into the outlet-side space per unit time according to the size of the sub-tank, the kind of ink, etc.

Further, according to the present invention, since a plurality of inflow channels are provided, the aperture configuration of each of the inflow channels can be set in various ways, and it is possible to allow the ink to flow into the outlet-side space from the inlet-side space even when a part of inflow channel is clogged with a bubble adhering to the inflow channel.

In addition, according to the present invention, since the inflow channel is a slit, when performing suction and removal of gas in the sub-tank by sucking the gas from the recording head side, the amount of ink in the outlet-side space which is sucked together with gas can be further reduced compared to the case where the inflow channel is in the shape of a round hole.

Further, according to the present invention, since the inflow channel as a slit is positioned so that the longitudinal direction thereof lies in the up-down direction, the inflow amount of ink into the outlet-side space from the inlet-side space per unit time can be set by varying the width dimension of the inflow channel throughout the entire length, or the length from the start end to the terminal end, and it is possible to easily set the inflow amount of ink into the outlet-side space per unit time according to the size of the sub-tank, the kind of ink, etc.

Additionally, according to the present invention, since the inflow channel is positioned between the inside surface of the sub-tank and the isolating member, the inflow channel can be formed when forming the isolating member integrally with or separately from the sub-tank main body, and the manufacturability of the sub-tank having the inflow channel can be improved.

Besides, according to the present invention, since the width dimension of the inflow channel is made shorter on the lower side of the sub-tank and longer on the upper side, the amount of ink in the outlet-side space which is sucked together with gas can be reduced, and the time taken for the ink level in the inlet-side space and the ink level in the outlet-side space to be in equilibrium after the suction and removal of gas can be reduced compared to the case where the inflow channel has the same width dimension throughout the entire length.

Moreover, according to the present invention, since the distance from the start end to the terminal end of the inflow channel is made longer on the lower side of the sub-tank and shorter on the upper side, the amount of ink in the outlet-side space which is sucked together with gas can be reduced, and the time taken for the ink level in the inlet-side space and the ink level in the outlet-side space to be in equilibrium after the suction and removal of gas can be reduced compared to the case where the inflow channel has the same width dimension throughout the entire length.

In addition, according to the present invention, since the isolating member is a plate with a width dimension smaller than the dimension between the opposing side faces in the sub-tank, the inflow channel can be formed when forming the isolating member integrally with or separately from the sub-tank main body, and the manufacturability of the sub-tank having the inflow channel can be improved.

Further, according to the present invention, since a recess to be an inflow channel is formed in the peripheral surface of the isolating member that is a separate plate from the sub-tank main body, the inflow channel can be formed when forming the isolating member, and the size and configuration of the inflow channel can be set without being influenced by the sub-tank main body.

Besides, according to the present invention, since the isolating member that is a separate plate from the sub-tank main body has the inflow channel, the inflow channel can be formed when forming the isolating member, and the size and configuration of the inflow channel can be set without being influenced by the sub-tank main body.

Moreover, according to the present invention, since the ink level in the outlet-side space can be detected by a detector, it is possible to obtain the ink level more accurately than by finding the ink level in the outlet-side space from the ink discharge time or the number of times of ink discharge, and it is possible to reduce the amount of ink in the outlet-side space which is sucked together with gas to a minimum necessary amount.

In addition, according to the present invention, since the member having the inflow channel is made of a material with a relatively high wettability, it is possible to prevent a bubble from being held in the inflow channel, achieve a stable connected state, and reduce the change in the inflow amount of ink per unit time.

Besides, according to the present invention, the next discharge of ink from the recording head can be performed in the state in which the ink level in the inlet-side space and the ink level in the outlet-side space are substantially in equilibrium, and stable supply of ink to the outlet-side space can be achieved.

Moreover, according to the present invention, since the suction for filling can be stopped at an inflection point at which the amount of ink filled is about 80% of the saturation value, it is possible to efficiently fill as much as possible ink when filling the ink into the sub-tank while sucking and removing the gas from the recording head side.

Further, according to the present invention, since the suction for filling can be stopped at the time the amount of ink filled reaches almost 80% of the saturation value, it is possible to more efficiently fill as much as possible ink when filling the ink into the sub-tank while sucking and removing the gas from the recording head side.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A recording apparatus constructed to supply ink to a sub-tank adjacent to a recording head from a main-tank, which is provided in the recording apparatus, through a tube and to supply the ink to the recording head from the sub-tank, comprising:

an isolating member having a substantially planar section extending substantially between opposing side wall portions of the sub-tank for separating in a horizontal direction an inside of said sub-tank into an inlet-side space connected to said main-tank and an outlet-side space connected to said recording head; and an inflow channel in a region of said isolating member for increasing ink level in the inlet-side space while allowing the ink in the inlet-side space to flow into the outlet-side space, extending between a region adjacent to a bottom of the isolating member and a region adjacent to an upper end of the isolating member: wherein said inflow channel is in the form of a slit.

said inflow channel is arranged so that a longitudinal direction thereof lies in an up-down direction, and said inflow channel has a shorter width dimension on a lower side of said sub-tank and a longer width dimension on an upper side.

2. The recording apparatus as set forth in claim 1, wherein said inflow channel has a size allowing inflow of the ink when the ink level is present at a position of said inflow channel, and a surface connected to a terminal end of said inflow channel is made of a material that is wettable by the ink.

3. The recording apparatus as set forth in claim 2, wherein said isolating member is in the form of a plate.

4. The recording apparatus as set forth in claim 2, wherein a plurality of said inflow channels are formed.

5. The recording apparatus as set forth in claim 2, wherein said inflow channel is positioned between an inside surface of said sub-tank and said isolating member.

6. The recording apparatus as set forth in claim 2, wherein a vicinity of said inflow channel has a surface that causes a contact angle of the ink to be 90 degrees or less from the terminal end of said inflow channel to the outlet-side space.

7. The recording apparatus as set forth in claim 1, wherein said isolating member is in the form of a plate.

8. The recording apparatus as set forth in claim 1, wherein a plurality of said inflow channels are formed.

9. The recording apparatus as set forth in claim 1, wherein a distance from a start end to a terminal end of said inflow channel is longer on a lower side of said sub-tank and shorter on an upper side.

10. The recording apparatus as set forth in claim 1, wherein said inflow channel is positioned between an inside surface of said sub-tank and said isolating member.

11. The recording apparatus as set forth in claim 1, wherein said sub-tank has a sub-tank main body coupled to said recording head, and said isolating member is a separate plate from said sub-tank main body and has said inflow channel.

12. The recording apparatus as set forth in claim 1, wherein said sub-tank has a detector for detecting an ink level in the outlet-side space.

13. The recording apparatus as set forth in claim 1, wherein a vicinity of said inflow channel has a surface that causes a contact angle of the ink to be 90 degrees or less from a terminal end of said inflow channel to the outlet-side space.

14. A recording apparatus constructed to supply ink to a sub-tank adjacent to a recording head from a main-tank. which is provided in the recording apparatus, through a tube and to supply the ink to the recording head from the sub-tank, comprising:

an isolating member having a substantially planar section extending substantially between opposing side wall portions of the sub-tank for separating in a horizontal direction an inside of said sub-tank into an inlet-side space connected to said main-tank and an outlet-side space connected to said recording head; and an inflow channel in a region of said isolating member for increasing ink level in the inlet-side space while allowing the ink in the inlet-side space to flow into the outlet-side space, extending between a region adjacent to a bottom of the isolating member and a region adjacent to an upper end of the isolating member, wherein:

said inflow channel is in the form of a slit, said inflow channel is positioned between an inside surface of said sub-tank and said isolating member, and said sub-tank has a sub-tank main body coupled to said recording head, and said isolating member is a plate with a width dimension smaller than a dimension between opposing side faces in said sub-tank main body.

15. A recording apparatus constructed to supply ink to a sub-tank adjacent to a recording head from a main-tank, which is provided in the recording apparatus, through a tube and to supply the ink to the recording head from the sub-tank, comprising:

an isolating member having a substantially planar section extending substantially between opposing side wall portions of the sub-tank for separating in a horizontal direction an inside of said sub-tank into an inlet-side space connected to said main-tank and an outlet-side space connected to said recording head; and an inflow channel in a region of said isolating member for increasing ink level in the inlet-side space while allowing the ink in the inlet-side space to flow into the outlet-side space, extending between a region adjacent to a bottom of the isolating member and a region adjacent to an upper end of the isolating member, wherein said inflow channel is in the form of a slit, said inflow channel is positioned between an inside surface of said sub-tank and said isolating member, and said sub-tank has a sub-tank main body coupled to said recording head, and said isolating member is a separate plate from said sub-tank main body and has a recess to be the inflow channel in a peripheral surface of said isolating member.

16. A recording apparatus constructed to supply ink to a sub-tank adjacent to a recording head from a main-tank, which is provided in the recording apparatus, through a tube and to supply the ink to the recording head from the sub-tank, comprising:

an isolating member having a substantially planar section extending substantially between opposing side wall portions of the sub-tank for separating in a horizontal direction an inside of said sub-tank into an inlet-side space connected to said main-tank and an outlet-side space connected to said recording head and an inflow channel in a region of said isolating member for increasing ink level in the inlet-side space while allowing the ink in the inlet-side space to flow into the outlet-side space, extending between a region adjacent to a bottom of the isolating member and a region adjacent to an upper end of the isolating member; wherein said inflow channel is positioned between an inside surface of said sub-tank and said isolating member, and said sub-tank has a sub-tank main body coupled to said recording head, and said isolating member is a plate with a width dimension smaller than a dimension between opposing side faces in said sub-tank main body.

17. A recording apparatus constructed to supply ink to a sub-tank adjacent to a recording head from a main-tank, which is provided in the recording apparatus, through a tube and to supply the ink to the recording head from the sub-tank, comprising:

an isolating member having a substantially planar section extending substantially between opposing side wall portions of the sub-tank for separating in a horizontal direction an inside of said sub-tank into an inlet-side space connected to said main-tank and an outlet-side space connected to said recording head and an inflow channel in a region of said isolating member for increasing ink level in the inlet-side space while allowing the ink in the inlet-side space to flow into the outlet-side space, extending between a region adjacent to a bottom of the isolating member and a region adjacent to an upper end of the isolating member; wherein said inflow channel is positioned between an inside surface of said sub-tank and said isolating member, and said sub-tank has a sub-tank main body coupled to said recording head, and said isolating member is a separate plate from said sub-tank main body and has recess to be the inflow channel in a peripheral surface of said isolating member.

18. A recording apparatus constructed to supply ink to a sub-tank adjacent to a recording head from a main-tank, which is provided in the recording apparatus, through a tube and to supply the ink to the recording head from the sub-tank, comprising:

an isolating member having a substantially planar section extending substantially between opposing side wall portions of the sub-tank for separating in a horizontal direction an inside of said sub-tank into an inlet-side space connected to said main-tank and an outlet-side space connected to said recording head and an inflow channel in a region of said isolating member for increasing ink level in the inlet-side space while allowing the ink in the inlet-side space to flow into the outlet-side space, extending between a region adjacent to a bottom of the isolating member and a region adjacent to an upper end of the isolating member; wherein said sub-tank has a sub-tank main body coupled to said recording head, and said isolating member is a plate with a width dimension smaller than a dimension between opposing side faces in said sub-tank main body.

19. A recording apparatus constructed to supply ink to a sub-tank adjacent to a recording head from a main-tank, which is provided in the recording apparatus, through a tube and to supply the ink to the recording head from the sub-tank, comprising:

an isolating member having a substantially planar section extending substantially between opposing side wall portions of the sub-tank for separating in a horizontal direction an inside of said sub-tank into an inlet-side space connected to said main-tank and an outlet-side space connected to said recording head; and an inflow channel in a region of said isolating member for increasing ink level in the inlet-side space while allowing the ink in the inlet-side space to flow into the outlet-side space, extending between a region adjacent to a bottom of the isolating member and a region adjacent to an upper end of the isolating member, wherein, if a base area of the inlet-side space is S ($m^2$), ink inflow resistance of said inflow channel is R ($N \cdot s/m^5$), and a time from completion of filling the ink into said sub-tank to discharge of the ink in said sub-tank from said recording head is To (second), then the R is set to satisfy $$R \cdot S/(9.8 \times 10^3) < To.$$

20. A recording apparatus constructed to supply ink to a sub-tank adjacent to a recording head from a main-tank, which is provided in the recording apparatus, through a tube and to supply the ink to the recording head from the sub-tank, comprising:

an isolating member having a substantially planar section extending substantially between opposing side wall portions of the sub-tank for separating in a horizontal direction an inside of said sub-tank into an inlet-side space connected to said main-tank and an outlet-side space connected to said recording head; and an inflow channel in a region of said isolating member for increasing ink level in the inlet-side space while allowing the ink in the inlet-side space to flow into the outlet-side space, extending between a region adjacent to a bottom of the isolating member and a region adjacent to an upper end of the isolating in member, wherein, if a saturation value of amount of ink filled into the inlet-side space is Mos, elapsed time when the amount of ink filled has reached 80% of the saturation value is Tc (second), and a time at which suction for filling is stopped is Te (second), then the Te/Tc is set to satisfy $$Te/Tc < 1.5 \text{(second)}.$$

21. The recording apparatus as set forth in claim 20, wherein, the Te and the Tc are set to satisfy $$Te \approx Tc.$$

* * * * *